US011311794B2

(12) United States Patent
Limaye

(10) Patent No.: US 11,311,794 B2
(45) **Date of Patent: *Apr. 26, 2022**

(54) ELECTRONIC GAMING DEVICE

(71) Applicant: Virtual Vectors LLC., Upper Saddle River, NJ (US)

(72) Inventor: Rajesh A. Limaye, Upper Saddle River, NJ (US)

(73) Assignee: Virtual Vectors LLC., Upper Saddle River, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/931,654

(22) Filed: Jul. 17, 2020

(65) Prior Publication Data

US 2020/0346104 A1 Nov. 5, 2020

Related U.S. Application Data

(63) Continuation of application No. 16/002,299, filed on Jun. 7, 2018, now Pat. No. 10,744,400.

(51) Int. Cl.
*A63F 9/08* (2006.01)
*A63F 9/24* (2006.01)

(52) U.S. Cl.
CPC .... *A63F 9/0842* (2013.01); *A63F 2009/2457* (2013.01)

(58) Field of Classification Search
CPC ..... A63F 9/08; A63F 9/0826; A63F 9/083; A63F 9/0834; A63F 9/0838; A63F 9/0842; A63F 2009/2457
See application file for complete search history.

(56) References Cited

U.S. PATENT DOCUMENTS 5,779,549 A 7/1998 Walker et al.
7,100,917 B2 9/2006 Wang
(Continued)

FOREIGN PATENT DOCUMENTS

CN 101690847 A 4/2010
CN 202995837 U 6/2013
(Continued)

*Primary Examiner* — Jasson H Yoo
(74) *Attorney, Agent, or Firm* — Cha & Reiter, LLC.; Mirut Dalal

(57) ABSTRACT

Presented herein is an electronic gaming device comprising a first axle with a first center cubelet rotatably coupled to the first axle, a first sensor operatively coupled to the first axle to detect rotation of the first cubelet, and responsive to detecting rotation of the first cubelet, transmit a first signal, a second axle with a second center cubelet rotatably coupled to the second axle, a second sensor operatively coupled to the second axle to detect rotation of the second cubelet, and responsive to detecting rotation of the second cubelet, transmit a second signal, a third axle with a third center cubelet rotatably coupled to the third axle, a third sensor operatively coupled to the third axle to detect rotation of the third cubelet, and responsive to detecting rotation of the third cubelet, transmit a third signal, a plurality of interchangeable cubelets positioned about the first, second, and third axle such that mechanical rotation of a set of the interchangeable cubelets having a common plane causes one of the first, second, and third sensors to transmit one of the first, second, and third signals, storage for storing a position of each of the plurality of interchangeable cubelets, and a processor configured to receive signals from one of the first, second, and third sensors, determine changes in the position of the some of the cubelets, and write the changed positions for the some of the cubelets in the storage.

7 Claims, 15 Drawing Sheets

(56) References Cited

U.S. PATENT DOCUMENTS

| | | | | |
|---|---|---|---|---|
| 8,387,984 | B2 | 3/2013 | Artsiely | |
| 8,398,470 | B2 | 3/2013 | Gillies et al. | |
| 8,465,020 | B2 | 6/2013 | Dai et al. | |
| 2010/0259001 | A1 | 10/2010 | Muller, III et al. | |
| 2011/0307834 | A1 | 12/2011 | Wu | |
| 2012/0032958 | A1* | 2/2012 | Werline | G06T 19/20 345/420 |
| 2014/0239588 | A1 | 8/2014 | Fry | |
| 2015/0125835 | A1* | 5/2015 | Wittich | A63F 3/0421 434/169 |
| 2015/0367230 | A1 | 12/2015 | Bradford et al. | |
| 2019/0114944 | A1* | 4/2019 | Garrett | A63F 9/0842 |

FOREIGN PATENT DOCUMENTS

| | | | |
|---|---|---|---|
| CN | 203029966 | U | 7/2013 |
| CN | 104857702 | A | 8/2015 |

* cited by examiner

ELECTRONIC GAMING DEVICE

CLAIM OF PRIORITY

This application is a Continuation of U.S. patent application Ser. No. 16/002,299, filed Jun. 7, 2018 by Rajesh Limaye, the entirety of which is hereby incorporated by reference for all purposes.

BACKGROUND

The Rubik's Cube™ made by Ernő Rubik was one of the most successful toys in history, selling more than 300 million units worldwide during the 1980's. The Rubik's Cube is a 3×3×3 gaming device that can attain 43,252,003, 274,489,856,000 (43 quintillion) combinations. However, the gaming device is only considered solved when it attains one specific combination (the solved combination, or "solved"). The objective is to randomly manipulate the gaming device to a random one of the possible combinations (also referred to as scrambling the gaming device) and then manipulate the gaming device from the random combination to the solved combination.

Users have used the gaming device for casual amusement and entertainment. The gaming device is even the object of competitions. Some competitors have been able to solve the gaming device in as little as six seconds.

Further limitations and disadvantages of conventional and traditional approaches will become apparent to one of skill in the art, through comparison of such systems with embodiments of the present disclosure as set forth in the remainder of the present application with reference to the drawings.

SUMMARY

According to certain embodiments of the present disclosure, there is presented an electronic gaming device comprising a first axle with a first center cubelet rotatably coupled to the first axle, a first sensor operatively coupled to the first axle to detect rotation of the first center cubelet, and responsive to detecting rotation of the first center cubelet, transmit a first signal, a second axle with a second center cubelet rotatably coupled to the second axle, a second sensor operatively coupled to the second axle to detect rotation of the second center cubelet, and responsive to detecting rotation of the second center cubelet, transmit a second signal, a third axle with a third center cubelet rotatably coupled to the third axle, a third sensor operatively coupled to the third axle to detect rotation of the third center cubelet, and responsive to detecting rotation of the third center cubelet, transmit a third signal, a plurality of interchangeable cubelets positioned about the first, second, and third axle such that mechanical rotation of a set of the interchangeable cubelets having a common plane causes one of the first, second, and third sensors to transmit one of the first, second, and third signals, storage for storing a position of each of the plurality of interchangeable cubelets, and a processor configured to receive signals from one of the first, second, and third sensors, determine changes in the position of the some of the plurality of interchangeable cubelets, and write the changed positions for the some of the plurality of interchangeable cubelets in the storage.

According to certain embodiments of the present disclosure, there is presented an electronic device comprising: a display, at least one processor connected to the display, a memory storing a plurality of executable instructions connected to the at least one processor, wherein execution of the plurality of executable instructions cause the at one processor to: receive an initial position of a plurality of interchangeable cubelets disposed about six axles; render the initial position of the plurality of interchangeable cubelets about the six axles on the display; receiving an identification of one of the six sensors, and direction of rotation; determine a set of cubelets from the initial position that caused the identified sensor to detect rotation; determine a new position of the set of cubelets about the six axles based on the direction of rotation, thereby resulting in a new position of the plurality of interchangeable cubelets, and render the new position of the plurality interchangeable cubelets based on the new position of the set of cubelets display.

Other aspects, advantages, and salient features of embodiments of the disclosure will become apparent to those skilled in the art from the following detailed description, taken in conjunction with the annexed drawings.

BRIEF DESCRIPTION OF THE DRAWINGS

The above and other aspects, features, and advantages of certain exemplary embodiments of the present disclosure will be more apparent from the following description taken in conjunction with the accompanying drawings, in which.

DETAILED DESCRIPTION

The following description describes certain embodiments and shall be understood to be only for the purpose of enabling a person of ordinary skill in the art to make and use the subject matter of any claims that are presently pending or may later be added, or which may issue in any patent. It shall be understood that the following embodiments are not limiting and nothing is essential or critical unless specifically designated.

Described herein is an electronic gaming device with interchangeable pieces that stores the position of each of the interchangeable pieces, and in response to a mechanical movement (such as a rotation) of some of the pieces, determines and writes the change in the position of the moved pieces. FIGS. 1A-2C describe an electronic gaming device with manually interchangeable pieces, storage that stores the position of each of the pieces, and sensors to detect rotations of sides of the electronic gaming device. With storage of the position of each of the pieces prior to rotation of a side of the electronic gaming device, and sensors to detect rotations, the electronic gaming device includes at least one processor that can determine the position of the pieces after each rotation. FIGS. 3-9 describe modes of operation of the electronic gaming device in conjunction with an electronic device. The modes of operation can include a Record Mode described in FIG. 5, a Timer Mode described in FIG. 6, a Replay Mode described in FIG. 7, a Synchronization Mode described in FIG. 8, and a Solve Mode described in FIG. 9. Additionally, FIG. 10 describes using the electronic gaming device over a network with other electronic gaming devices.

Figure 1A:
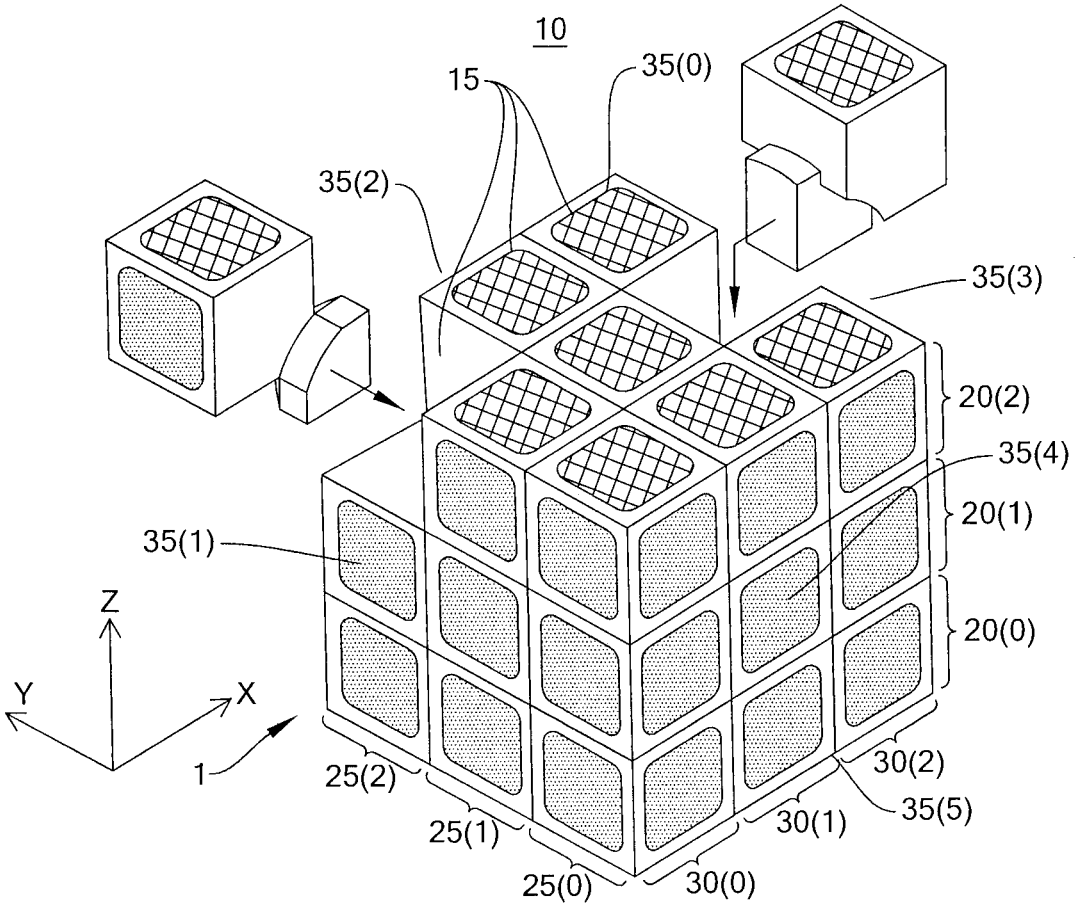
FIG. 1A is a block diagram of an electronic gaming device in accordance with an embodiment of the present disclosure.
Figure 1B:
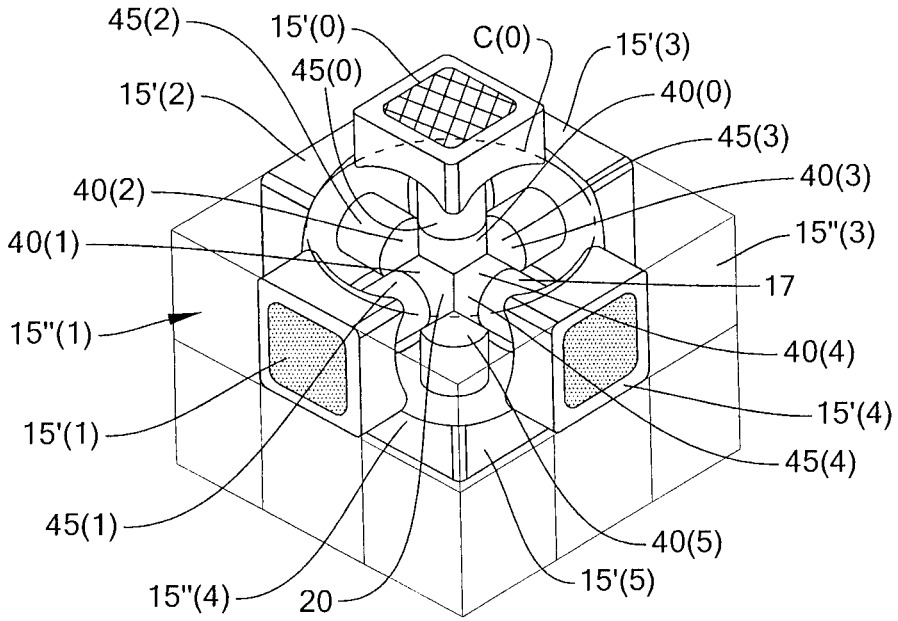
FIG. 1B is a block diagram describing the interior of an electronic gaming device in accordance with an embodiment of the present disclosure.
Figure 1C:
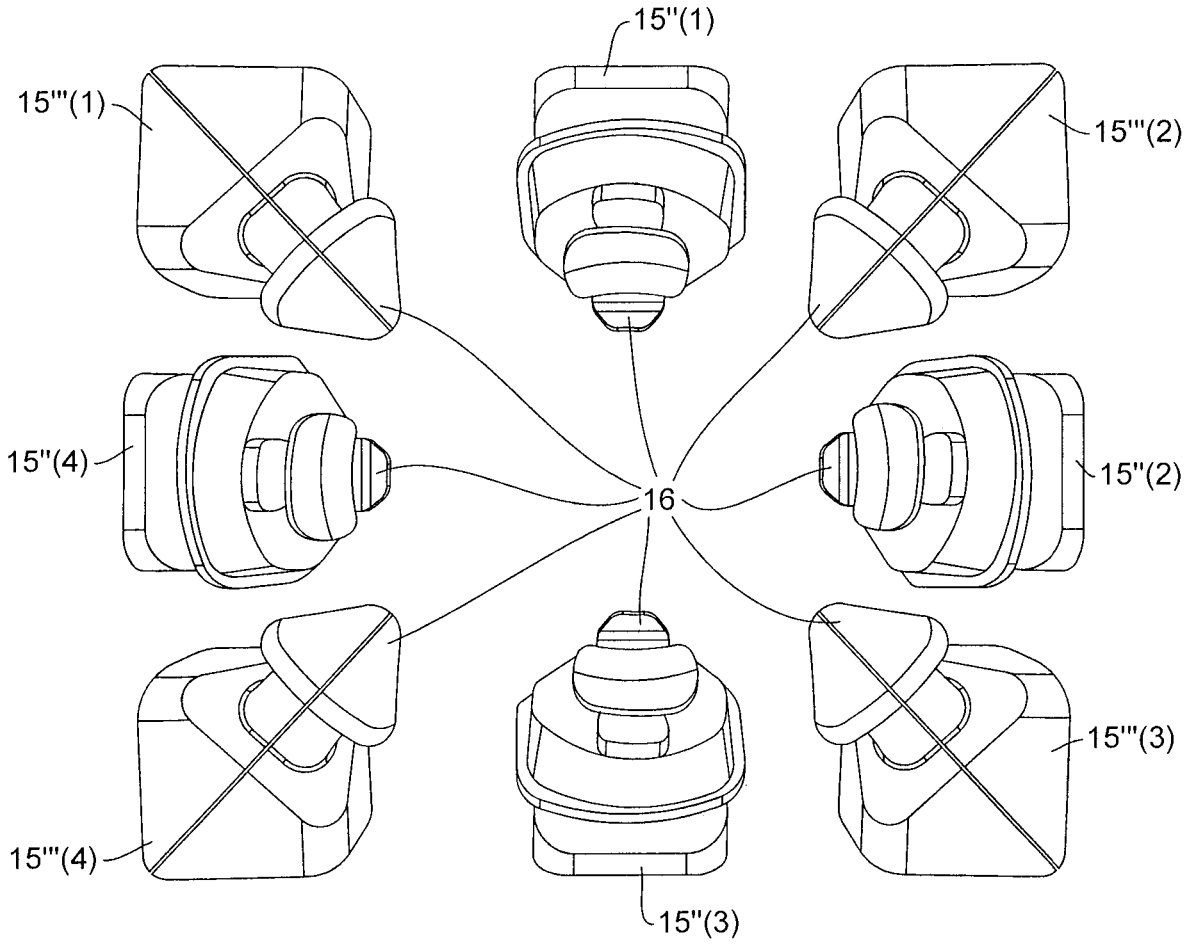
FIG. 1C is a rear view of cubelets forming a side of an electronic gaming device in accordance with an embodiment of the present disclosure.

FIGS. 1A, 1B, and 1C are block diagrams of an electronic gaming device 10 comprising a plurality of interchangeable pieces 15 in accordance with an embodiment of this disclosure. The electronic gaming device 10 includes sensors (which will be described in FIG. 1B) that are configured to detect mechanical rotation of some of the interchangeable pieces 15. Based on detection by the sensors, at least one processor determines the changed position of some of the interchangeable pieces 15 and writes the changed position of the some of the interchangeable pieces to storage.

Turning to FIG. 1A, the electronic gaming device 10 includes a plurality of interchangeable pieces 15. In certain embodiments, the interchangeable pieces 15 can be arranged to form a 3×3×3 cubic structure, though the cubic structure is not limited to 3×3×3. The interchangeable pieces 15 can comprise cubelets 15 including center cubelets 15', edge cubelets 15", and corner cubeles 15''' (which will be described in further detail in FIG. 1B). The cubelets 15 can be arranged in three xy plane layers 20(0), 20(1), and 20(2), three xy plane layers 25(0), 25(1), and 25(2), and three yz plane layers 30(0), 30(1), and 30(2).

FIG. 1B shows the interior of the electronic gaming device 10. Each of the cubelets 15 can have either one (a center cubelet 15'), two (an edge cubelet 15"), or three surfaces (a corner cubelet 15''') that are exposed from the exterior (it is noted that in the present embodiment, there is no "core" cubelet). In certain embodiments, the exposed surfaces of each cubelet 15 have particular colors. The exposed surfaces can have a common plane, together forming a planar surface, or side 35(0), 35(1) . . . 35(5) of the electronic gaming device 10.

The interior of the electronic gaming device 10 includes axles 40(0) . . . 40(5), each of which are rotatably coupled to a center cubelet 15'(0) . . . 15'(5). Sensors 45(0) . . . 45(5) operatively coupled to the axles 40(0) . . . 40(5) detect rotation of respective center cubelets 15'(0) . . . 15'(5) about respective axles 40(0) . . . 40(5). The edge cubelets 15" and center cubelets 15' along a common plane form two circular openings inside the electronic gaming device 10 (top circular opening C(0) is shown, bottom circular opening is not shown). For example, edge cubelets 15"(1) . . . 15"(4) and center cubelets 15'(1) . . . 15'(4) form a circular opening about the xy plane. Additionally rotation of sides 35(1) and 35(3) causes edge cubelets 15"(1) and 15"(4), and 15"(2) and 15"(3), to form two circular openings in the xz plane with center cubelets 15'(0) and 15'(1), and 15'(3), 15'(5), respectively. The middle layers 20(1), 25(1), and 30(1) form interior circular openings behind each side 35(0) . . . 35(5).

Referring now to FIG. 1C, there is shown a rear view of edge cubelets 15"(1) . . . 15"(4) and corner cubelets 15'''(1) . . . 15'''(4) forming a side 35 (note that the parenthetical references in FIG. 1C are not intended to correspond with the parenthetical references in FIG. 1B). The edge cubelets 15''' and corner cubelets 15''' are configured to surround a center cubelet 15'. Additionally, the corner cubelets 15''' and edge cubelets 15" have protrusions 16 that form portions of a sphere. The edges of the protrusions 16 form a circular cross-section corresponding to the circular opening surrounding axles 40(0) . . . 40(5). Rotation of the cubelets 15 that are shared with an orthogonal side, e.g., cubelets 15'''(1), 15"(4), 15'''(4), cause a protrusion 16 of cubelet 15'''(4) to replace the protrusion 16 of cubelet 15'''(1), or vice versa, thereby maintaining the sphere and circular cross section.

Returning to FIG. 1, each side 35(0) . . . 35(5) can be mechanically rotated by gripping the cubes in a corresponding layer and rotating in increments of substantially 90 degrees, e.g., layer 20(2) for side 35(0), layer 30(0) for side 35(1), layer 25(2) for side 35(2), layer 30(2) for side 35(3), layer 25(0) for side 35(4), and layer 20(0) for side 35(5).

During rotation of side 35(0), the sphere formed by the protrusions of the cubelets 15 of layer 20(2) rotate inside the circular openings formed by the cubelets of layer 25(1). The cubelets 15 that are part of layer 20(2) and layers 25(0), 25(1), and 25(2), become part of layers 30(0), 30(1), and 30(2), and vice versa. When the rotation is substantially 90 degrees, each of the circular openings are maintained as shown in FIG. 1B, but by different edge cubelets 15'. Additionally, each circular cross-section is also maintained as shown in FIG. 1C, but by different cubelets 15.

In the foregoing manner, cubelets 15 can be interchanged by rotating selected sides 35, any number of times. In fact, in 3×3×3 cubic structures, the cubelets 15 are capable of 43 quintillion different positions. In some embodiments, when the cubelets 15 are positioned such that the exposed surfaces of each cubelet forming each side 35(0) . . . 35(5) have the same color, the electronic gaming device 10 is considered solved. It is noted that other schemes can be used. For example, the cubelets 15 forming each side 35(0) . . . 35(5) can form different pictures. A rotation of a side 35 by "substantially 90 degrees", or "substantially −90 degrees", shall be understood to mean within a range of +/−90 degrees such that following the rotation, an other side 35 that is orthogonal to the side can be rotated.

It is further noted that rotation of a side 35 causes the same rotation of a center cubelet 15' that is part of the side to similarly rotate about an axle 40. A sensor 45 operatively coupled to the axle 40 detects the rotation of the center cubelet 15'.

Figure 2A:
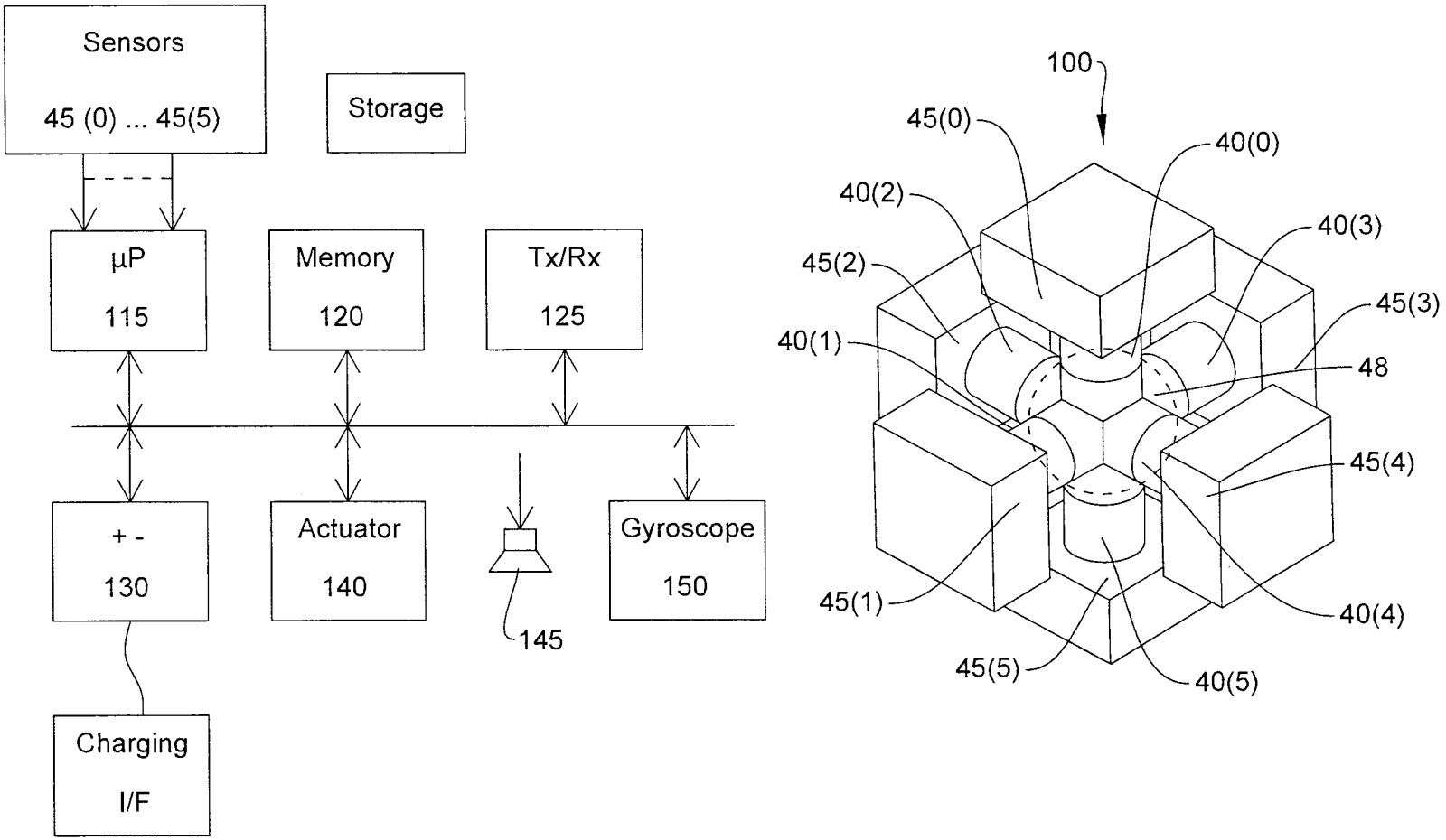
FIG. 2A is a block diagram of a core portion of an electronic gaming device in accordance with an embodiment of the present disclosure.

Referring now to FIG. 2A, there is illustrated a core portion 100 of the electronic gaming device 10. The core 100 of the electronic gaming device 10 can comprise axles 40(0) . . . 40(5), and center cubelets 15'(0) . . . 15'(5), sensors 45(0) . . . 45(5), at least one processor 115, memory 120, a transceiver 125, battery 130, charging interface 135, an actuator 140, a speaker 145, and a gyroscope 150. Additionally, the electronic gaming device 10 can include storage that stores a position of each of the plurality of interchangeable cubelets. As will be explained below, in certain embodiments, the storage can either form a dedicated portion of memory 120 or include data registers in the at least one processor 115. The core 100 of the electronic gaming device 10 can include axles 40(0) . . . 40(5), comprising pairs of collinear axles 40(0)/40(5), 40(1)/40(3), and 40(2)/40(4) forming three orthogonal axes. In some embodiments, the axles 40 can emerge from a point, while in other embodiments, the axles can emerge from a sphere 48. Each center cubelet 15'(0) . . . 15'(5) can be rotatably coupled to a respective axle 40(0) . . . 40(5). Sensors 45(0) . . . 45(5) are operatively coupled to the axles 40(0) . . . 40(5) near the point where the respective center cubelets 15'(0) . . . 15'(5) are connected. Each sensor 45(0) . . . 45(5) can be configured to detect a rotation a center cubelet 15'(0) . . . 15'(5) about a respective axle 40(0) . . . 40(5), and provide information identifying itself, rotation direction information, and timing information.

In some embodiments, the center cubelets 15'(0) . . . 15'(5) can include a magnet that rotates around the axles 40(0) . . . 40(5). The sensors 45(0) . . . 45(5) can include, for example, a Hall sensor. In some embodiments, the axles 40(0) . . . 40(5) can include Hall sensors disposed at incremental degrees about the axles 40(0) . . . 40(5), such as substantially at every 15, 30, 45, 90 degrees.

When a sensor 45(0) . . . 45(5) detects rotation of a center cubelet 15'(0) . . . 15'(5), the sensor 45(0) . . . 45(5) sends a signal including information identifying itself, rotation direction information, and timing information to the at least one processor 115. The direction of rotation can be in a positive direction or negative direction. Many schemes can be used as a reference direction, for example, the "righthand rule." In the righthand rule, positive degrees are the direction that the fingers curl when the right thumb is pointed in the direction of the axle 40/center cubelet 15'. It is noted that the righthand rule unambiguously defines direction for any orientation of the cube.

In some embodiments, the sensors 45 can transmit a signal detecting rotation of a center cubelet 15' in predetermined increments, which can be fine, such as every 1 degree, more coarse, such as every 15/30/45 degrees, or substantially 90 degrees.

When the at least one processor 115 receives a signal or series of signals from a sensor in aggregate indicating rotation of a center cubelet 15' by substantially −90 or 90 degrees (a rotation of a center cubelet 15' by substantially 180 degrees can be two rotations by substantially −90 degrees, or 90 degrees), the at least one processor 115 determines a change in the position of some of the cubelets 15. In some embodiments, the sensors 45(0) . . . 45(5) signal the at least one processor 115 only when a rotation of substantially +−90 degrees occurs. In other embodiments, the sensors 45(0) . . . 45(5) signal the at least one processor 115 at every detection of a rotation, and the at least one processor 115 detects when the total of the detected rotations is substantially +−90 degrees.

By receiving signals from a particular one of the sensors 45(0) . . . 45(5), the at least one processor 115 determines when a center cubelet 15' is rotated substantially −90 or +90 degrees. A rotation of a center cubelet 15' by substantially −90 or +90 degrees is indicative of a user rotation of a side 35, resulting in the interchanging or rearranging of a set of cubelets 15. With the position of each of the cubelets before the rotation written in storage, and signal(s) from a particular one of the sensors 45(0) . . . 45(5) indicating movement of substantially −90 degree or 90 degrees, the at least one processor 115 can determine which ones of the cubelets 15 change position, and write the changed positions of cubelets changing positions in the storage as will be described in greater detail below.

The memory 120 can store programs and data. The programs can comprise instructions that are executable by the at least one processor 115. The memory also stores a serial number uniquely identifying the game cube. The serial number can include for example, a MAC address, or Bluetooth address.

The storage stores the position of each of the plurality of interchangeable cubelets. In some embodiments, the storage storing the position of each cubelet 15 can be a dedicated portion of memory 120, a high-speed cache memory, or data registers in the at least one processor 115. In some embodiments, the position of each cubelet 15 can be loaded to data registers controlled by the at least one processor 115 during times that the user is operating the gaming device, or when a predetermined number of user rotations are detected in a given time frame. At manufacture, the storage can be loaded with the position of each cubelet (most likely the solved position) and is updated each time a sensor 45(0) . . . 45(5) detects a rotation of substantially +−90 degrees. As noted above, when a user manually rotates a side 35(0) . . . 35(5) +−90 degrees, the sensor 45(0) . . . 45(5) associated with the rotated side 35(0) . . . 35(5) will send a signal to the at least one processor 115. The at least one processor 115, in response to receiving a signal from one of the sensors, determines the cubelets 15 that have changed position and their changed position, and writes the changed positions for the cubelets 15 that have changed position in the storage The foregoing will be described in greater detail below with respect to FIGS. 2B-2E.

The transceiver 125 can be configured to communicate using a predetermined protocol such as, but not limited to Bluetooth, ZigBee, WiFi P2P, and NFC, to name a few, with an external electronic device. The battery 130 powers the electronic gaming device 10. In some embodiments, the battery 130 is disposed in the center of the core and connected to a charging interface 135 disposed inside one of the center cubelets 15' via a conductive path through one of the axles 40(0) . . . 40(5). The charging interface 135 can be detachably connected to a power outlet via a charging chord. In some embodiments, the charging interface 135 can be a charging coil capable of wirelessly charging the battery 130.

The actuator 140 can cause a mechanical vibration causing the electronic gaming device 10 to vibrate. For example, when the at least one processor 115 detects that the electronic gaming device 10 has become solved, the actuator 140 can be configured to generate a brief vibration. The speaker 145 can be configured to provide audible communication to the user. For example, the speaker 145 can communicate suggested turns to the user, such as "Turn the Red face from Yellow towards Blue."

The gyroscope 150 determines the orientation of the electronic gaming device 10. In some embodiments, when a sensor 45(0) . . . 45(5) detecting a rotation, rotation direction information and timing information are recorded, information from the gyroscope 150 can also be recorded.

As noted above, the storage can store the position of each cubelet and can write changed position for cubelets that have changed positions when a sensor 45(0) . . . 45(5) detects a rotation. In certain embodiments, the position of each cubelet 15 at manufacture can be in the solved position. In certain embodiments, each cubelet 15 can be identified by its surface colors, while the location is identified by the color of the adjacent center cubelet 15'. As noted above, the sensors 45(0) . . . 45(5) detect rotation of center cubelets 15'(0) . . . 15'(5), respectively. The color of a center cubelet 15'(0) . . . 15'(5) can be associated with the identity, or number of the sensor 45(0) . . . 45(5) that detects its rotation. For example, where sensor 45(0) detects rotation of center cubelet 15'(0), the color of center cubelet 15'(0) can be identified by the number 0.

Each cubelet 15 can be assigned an identification based on the colors on its surface. For example, a cubelet 15 with the identifier "012" can have the colors associated with colors 0, 1, and 2. The position of each cubelet 15 is determined by the center cubelets 15'. For example, at manufacture, the cubelet identified as "012" will be positioned such that the surface with color 0 is adjacent to center cubelet 15'(0), the surface with color 1 is adjacent to center cubelet 15'(1), and the surface with color 2 is adjacent to center cubelet 15'(2).

Additionally, the electronic gaming device 10 can store a table correlating the numbers to actual colors. While internally the electronic gaming device 10 may recognize the cubelets 15 by numbers, for user interfaces, using actual colors may be considered more "user friendly." For example, electronic gaming device 10 may store the following information in a table in storage: 0=Red, 1=White, 2=Blue, 3=Yellow, 4=Green, and 5=Orange.

Therefore, if the position of cubelets 15 at manufacture is in the solved position, the position of the cubelets 15 can initially be recorded as follows:

TABLE 1

| Cube ID | Side that $1^{st}$ color is on | Side that $2^{nd}$ color is on | Side that 3rd color is on (if corner) |
|---|---|---|---|
| 01 | 0 | 1 | |
| 012 | 0 | 1 | 2 |
| 02 | 0 | 2 | |
| 023 | 0 | 2 | 3 |
| 03 | 0 | 3 | |
| 034 | 0 | 3 | 4 |
| 04 | 0 | 4 | |
| 014 | 0 | 1 | 4 |
| 12 | 1 | 2 | |
| 23 | 2 | 3 | |
| 34 | 3 | 4 | |
| 14 | 1 | 4 | |
| 15 | 1 | 5 | |
| 125 | 1 | 2 | 5 |
| 25 | 2 | 5 | |
| 235 | 2 | 3 | 5 |
| 35 | 3 | 5 | |
| 345 | 3 | 4 | 5 |
| 45 | 4 | 5 | |
| 135 | 1 | 3 | 5 |

The memory 120 can store a program that, when executed by at least one processor 115, causes the at least one processor 115 to, in response to receiving a signal from a particular sensor 45, determine the set of cubelets 15 that are moved and determine a change in their position.

In certain embodiments, the program makes the following changes:

When signal from Sensor 45(0)
- If +90(0+), for all cubelets with column entry 0
  - Change 1 to 4
    - 4 to 3
    - 3 to 2
    - 2 to 1
- If −90(0−), for all cubelets with column entry 0
  - Change 4 to 1
    - 3 to 4
    - 2 to 3
    - 1 to 2

When signal from Sensor 45(1)
- If +90(1+), for all cubelets with column entry 1
  - Change 4 to 0
    - 0 to 2
    - 2 to 5
    - 5 to 4
- If −90 (1−), for all cubelets with column entry 1
  - Change 0 to 4
    - 2 to 0
    - 5 to 2
    - 4 to 5

When signal from Sensor 45(2)
- If +90 (2+), for all cubelets with column entry 2
  - Change 0 to 3
    - 3 to 5
    - 5 to 1
    - 1 to 0
- If −90 (2−), for all cubelets with column entry 2
  - Change 3 to 0
    - 5 to 3
    - 1 to 5
    - 0 to 1

When signal from Sensor 45(3)
- If +90 (3+), for all cubes with column entry 3
  - Change 0 to 4
    - 4 to 5
    - 5 to 2
    - 2 to 0
- If −90 (3−), for all cubes with column entry 3
  - Change 4 to 0
    - 5 to 4
    - 2 to 5
    - 0 to 2

When signal from Sensor 45(4)
- If +90 (4+), for all cubes with column entry 4
  - Change 3 to 0
    - 5 to 3
    - 1 to 5
    - 0 to 1
- If −90 (4−), for all cubes with column entry 4
  - Change 0 to 3
    - 3 to 5
    - 5 to 1
    - 1 to 0

When signal from Sensor 45(5)
- If +90 (5+), for all cubes with column entry 5
  - Change 4 to 1
    - 1 to 2
    - 2 to 3
    - 3 to 4

If −90 (5−), for all cubes with column entry 5
Change 1 to 4
2 to 1
3 to 2
4 to 3

Therefore, with an initial position of the cubelets 15, an identification of a detecting sensor 45, and a rotation direction, the resulting position of the cubelets 15 can be determined.

Figure 2B:
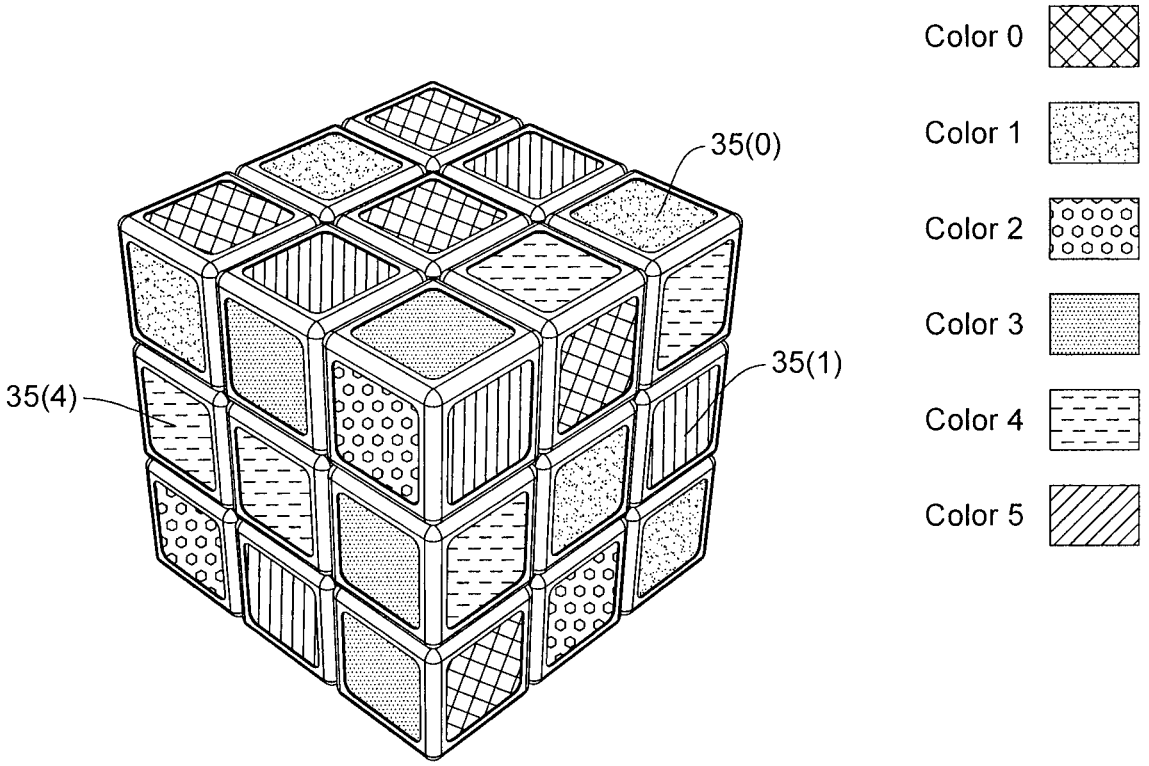
FIGS. 2B and 2C are block diagrams describing the position of cubelets of an electronic gaming device before a rotation in accordance with an embodiment of the present disclosure.
Figure 2C:
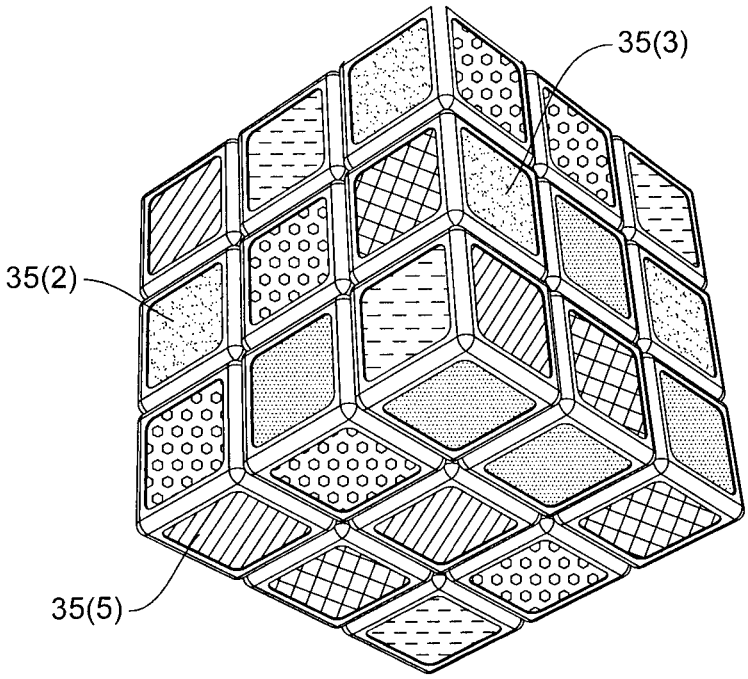

Referring now to FIGS. 2B (showing sides 35(0), 35(1), and 35(4)) and 2C (showing sides 35(2), 35(3), and 35(5)), there is illustrated a block diagram showing an initial position of a scrambled electronic gaming device 10. The registers of the at least one processor 115 or the memory 120 can store the position of the cubelets 15 in a table or data structure, such as Table 2. In some embodiments, the position of the cubelets 15 can be stored in data registers in the at least one processor 115.

TABLE 2

| Cube ID | Side that 1st color is on | Side that 2nd color is on | Side that 3rd color is on (if corner) |
|---|---|---|---|
| 01 | 4 | 0 | |
| 012 | 4 | 5 | 1 |
| 02 | 2 | 5 | |
| 023 | 5 | 2 | 1 |
| 03 | 5 | 4 | |
| 034 | 0 | 2 | 3 |
| 04 | 3 | 2 | |
| 014 | 0 | 2 | 1 |
| 12 | 4 | 1 | |
| 23 | 3 | 5 | |
| 34 | 2 | 0 | |
| 14 | 1 | 2 | |
| 15 | 3 | 0 | |
| 125 | 3 | 2 | 5 |
| 25 | 1 | 0 | |
| 235 | 0 | 1 | 4 |
| 35 | 5 | 1 | |
| 345 | 3 | 4 | 5 |
| 45 | 3 | 4 | |
| 145 | 4 | 0 | 3 |

Figure 2D:
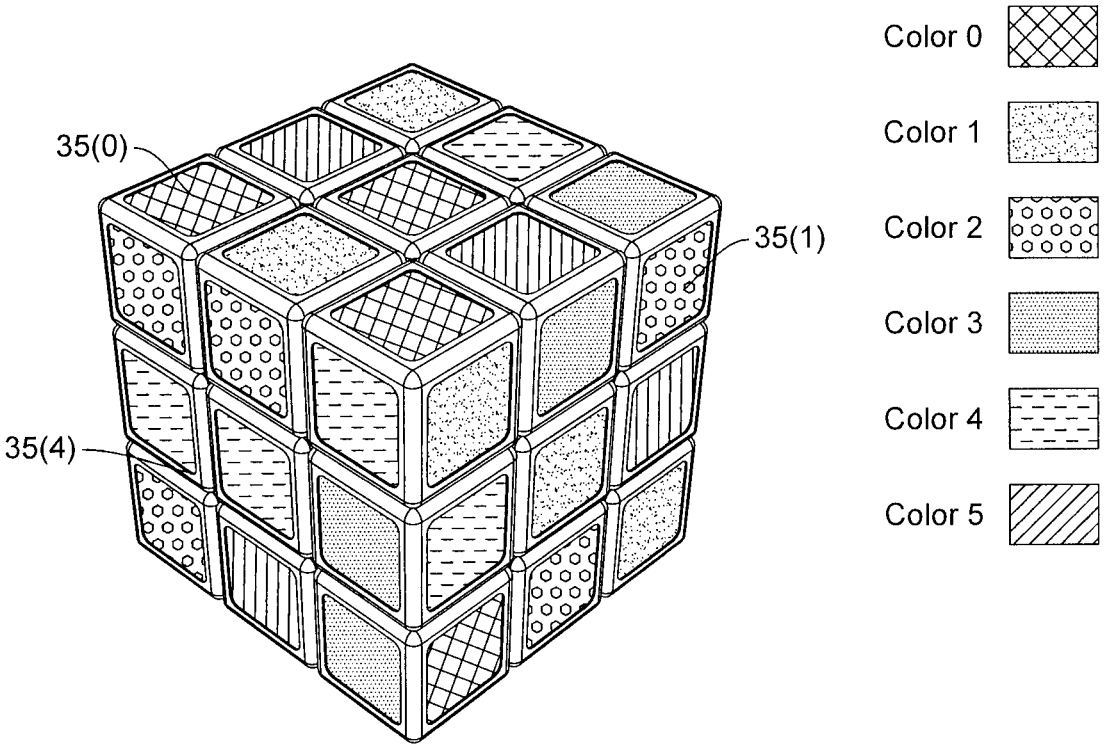
FIGS. 2D and 2E are block diagrams describing the position of cubelets of an electronic gaming device after a rotation in accordance with an embodiment of the present disclosure.
Figure 2E:
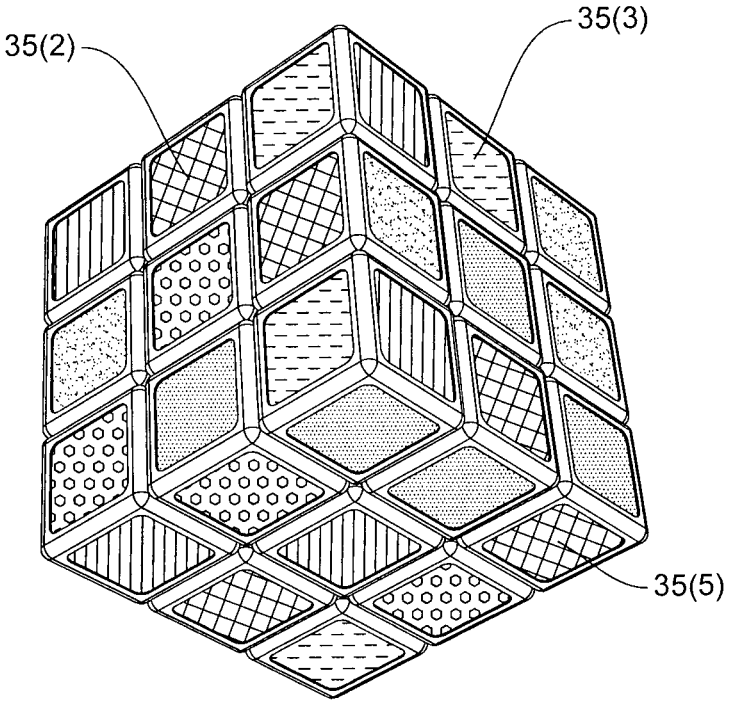

When a user rotates side 35(0) counterclockwise, the resulting state of the game cube is shown in FIG. 2D (showing sides 35(0), 35(1), 35(4)) and FIG. 2E (showing sides 35(2), 35(3), and 35(5)). Sensor 35(0) detects that center cubelet 15'(0) has rotated substantially +90 degrees (using the right hand rule), sends a signal to the at least one processor 115, indicating sensor 35(0) has detected a substantially +90 degree rotation, and the time of the rotation. Given the initial state of the electronic gaming device 10 (Table 2), identity of the sensor 35(0), direction information, substantially +90 degrees, the at least one processor 115 can determine a change in the position of the cubelets 15. For example, the at least one processor 115 determines that the position of cubelets 15 that have a visible surface on side 35(0) are changed. For each cubelet with a visible surface on side 35(0), change 1 to 4, 4 to 3, 3 to 2, and 2 to 1. Thus, the resulting state of the game cube 10 is shown in TABLE 3.

TABLE 3

| Cube ID | Center Piece Adjacent to 1st Color | Adjacent to 2nd Color | Adjacent to 3rd Color (if corner) |
|---|---|---|---|
| 01 | 3 | 0 | |
| 012 | 4 | 5 | 1 |
| 02 | 2 | 5 | |

TABLE 3-continued

| Cube ID | Center Piece Adjacent to 1st Color | Adjacent to 2nd Color | Adjacent to 3rd Color (if corner) |
|---|---|---|---|
| 023 | 5 | 2 | 1 |
| 03 | 5 | 4 | |
| 034 | 0 | 1 | 2 |
| 04 | 3 | 2 | |
| 014 | 0 | 1 | 4 |
| 12 | 4 | 1 | |
| 23 | 3 | 5 | |
| 34 | 1 | 0 | |
| 14 | 1 | 2 | |
| 15 | 2 | 0 | |
| 125 | 3 | 2 | 5 |
| 25 | 4 | 0 | |
| 235 | 0 | 4 | 3 |
| 35 | 5 | 1 | |
| 345 | 3 | 4 | 5 |
| 45 | 3 | 4 | |
| 145 | 3 | 0 | 2 |

In another embodiment, a data structure can include matrices, corresponding to each side 35(0) . . . 35(5). The matrix corresponding to each side can have the color identifiers (0 . . . 5) of the surfaces of the cubelets 15' that form each side 35(0) . . . 35(5).

| Side 0 | | | Side 1 | | | Side 2 | | |
|---|---|---|---|---|---|---|---|---|
| 0 | 1 | 0 | 5 | 0 | 4 | 5 | 4 | 1 |
| 5 | 0 | 5 | 4 | 1 | 5 | 1 | 2 | 0 |
| 3 | 4 | 1 | 0 | 2 | 1 | 2 | 3 | 1 |
| **Side 3** | | | **Side 4** | | | **Side 5** | | |
| 2 | 2 | 4 | 1 | 3 | 2 | 5 | 4 | 3 |
| 1 | 3 | 1 | 4 | 4 | 3 | 0 | 5 | 3 |
| 5 | 0 | 3 | 2 | 5 | 3 | 4 | 2 | 0 |

In the foregoing data structures, when sensor 45(0) detects a substantially 90 degrees rotation of side 35(0), multiply the matrix for side 35(0) by the following matrix:

| | | |
|---|---|---|
| 0 | 0 | 1 |
| 0 | 1 | 0 |
| 1 | 0 | 0 |

Move the top row of Side 1 to Side 2, Side 2 to Side 3, Side 3 to Side 4, and Side 4 to Side 1. The foregoing would result in the following data structure:

In another embodiment, a data structure can include matrices, corresponding to each side 35(0) . . . 35(5). The matrix corresponding to each side can have the color identifiers (0 . . . 5) of the surfaces of the cubelets 15' that form each side 35(0) . . . 35(5).

| Side 0 | | | Side 1 | | | Side 2 | | |
|---|---|---|---|---|---|---|---|---|
| 0 | 1 | 0 | 5 | 0 | 4 | 5 | 4 | 1 |
| 5 | 0 | 5 | 4 | 1 | 5 | 1 | 2 | 0 |
| 3 | 4 | 1 | 0 | 2 | 1 | 2 | 3 | 1 |
| **Side 3** | | | **Side 4** | | | **Side 5** | | |
| 2 | 2 | 4 | 1 | 3 | 2 | 5 | 4 | 3 |
| 1 | 3 | 1 | 4 | 4 | 3 | 0 | 5 | 3 |
| 5 | 0 | 3 | 2 | 5 | 3 | 4 | 2 | 0 |

In the foregoing data structures, when sensor 45(0) detects a substantially 90 degrees rotation of side 35(0), multiply the matrix for side 35(0) by the following matrix:

| | | |
|---|---|---|
| 0 | 0 | 1 |
| 0 | 1 | 0 |
| 1 | 0 | 0 |

Move the top row of Side 1 to Side 2, Side 2 to Side 3, Side 3 to Side 4, and Side 4 to Side 1. The foregoing would result in the following data structure:

| Side 0 | | | Side 1 | | | Side 2 | | |
|---|---|---|---|---|---|---|---|---|
| 0 | 5 | 1 | 1 | 3 | 2 | 5 | 0 | 4 |
| 1 | 0 | 4 | 4 | 1 | 5 | 1 | 2 | 0 |
| 0 | 5 | 3 | 0 | 2 | 1 | 2 | 3 | 1 |
| **Side 3** | | | **Side 4** | | | **Side 5** | | |
| 5 | 4 | 1 | 2 | 2 | 4 | 5 | 4 | 3 |
| 1 | 3 | 1 | 4 | 4 | 3 | 0 | 5 | 3 |
| 5 | 0 | 3 | 2 | 5 | 3 | 4 | 2 | 0 |

In certain embodiments, the at least one processor 115 can include a program that performs the following:

When sensor 45 detects a center cubelet rotating, multiply the matrix associated with side by When substantially 90 degrees:

| | | |
|---|---|---|
| 0 | 0 | 1 |
| 0 | 1 | 0 |
| 1 | 0 | 0 |

When substantially −90 degrees

| | | |
|---|---|---|
| 1 | 0 | 0 |
| 0 | 1 | 0 |
| 0 | 0 | 1 |

When signal from Sensor 45(0),

- When substantially +90 degrees
  - Multiply Matrix for Side 0 by 1st Matrix
  - Change 1st Row of Matrix for Side 1 to 1st Row of Matrix for Side 2
  - Change 1st Row of Matrix for Side 2 to 1st Row of Matrix for Side 3
  - Change 1st Row of Matrix for Side 3 to 1st Row of Matrix for Side 4
  - Change 1st Row of Matrix for Side 4 to 1st Row of Matrix for Side 1
- When substantially −90 degrees
  - Multiply Matrix for Side 0 by 2nd Matrix
  - Change 1st Row of Matrix for Side 4 to 1st Row of Matrix for Side 1
  - Change 1st Row of Matrix for Side 3 to 1st Row of Matrix for Side 4
  - Change 1st Row of Matrix for Side 2 to 1st Row of Matrix for Side 3
  - Change 1st Row of Matrix for Side 1 to 1st Row of Matrix for Side 2

When signal from Sensor 45(1)

- When substantially +90 degrees
  - Multiply Matrix for Side 1 by 1st Matrix
  - Change 3st Row of Matrix for Side 0 to 3rd Column of Matrix for Side 4
  - Change 3rd Column of Matrix for Side 4 to 1st Row of Matrix for Side 5
  - Change 1st Row of Matrix for Side 5 to 1st Column of Matrix for Side 2
  - Change 1st Column of Matrix for Side 2 to 3rd Row of Matrix for Side 0
- When substantially −90 degrees
  - Multiply Matrix for Side 1 by 2nd Matrix
  - Perform Opposite for Matrices for sides 0, 2, 4, and 5

When signal from Sensor 45(2)

- When substantially +90 degrees
  - Multiply Matrix for Side 2 by 1st Matrix
  - Change 3st Column of Matrix for Side 0 to 3rd Column of Matrix for Side 3
  - Change 3rd Column of Matrix for Side 3 to 3rd Column of Matrix for Side 5
  - Change 3rd Column of Matrix for Side 5 to 3rd Column of Matrix for Side 1
  - Change 3rd Column of Matrix for Side 1 to 3rd Column of Matrix for Side 0
- When substantially −90 degrees
  - Multiply Matrix for Side 2 by 2nd Matrix
  - Perform Opposite for Matrices for sides 0, 1, 3, and 5

When signal from Sensor 45(3)

- When substantially +90 degrees
  - Multiply Matrix for Side 3 by 1st Matrix
  - Change 1st Row of Matrix for Side 0 to 3rd Column of Matrix for Side 2
  - Change 3rd Column of Matrix for Side 2 to 3rd Row of Matrix for Side 5
  - Change 3st Row of Matrix for Side 5 to 1st Column of Matrix for Side 4
  - Change 1st Column of Matrix for Side 4 to 1st Row of Matrix for Side 0
- When substantially −90 degrees
  - Multiply Matrix for Side 3 by 2nd Matrix
  - Perform Opposite for Matrices for sides 0, 2, 4, and 5

When signal from Sensor 45(4)

- When substantially +90 degrees
  - Multiply Matrix for Side 4 by 1st Matrix
  - Change 1st Column of Matrix for Side 0 to 3rd Column of Matrix for Side 3
  - Change 3rd Column of Matrix for Side 3 to 1st Column of Matrix for Side 5
  - Change 1st Column of Matrix for Side 5 to 1st Column of Matrix for Side 1
  - Change 1st Column of Matrix for Side 1 to 1st Column of Matrix for Side 0
- When substantially −90 degrees
  - Multiply Matrix for Side 4 by 2nd Matrix
  - Perform Opposite for Matrices for sides 0, 1, 3, and 5

When signal from Sensor 45(5)

- When substantially +90 degrees
  - Multiply Matrix for Side 5 by 1st Matrix
  - Change 3rd Column of Matrix for Side 1 to 3rd Column for Side 4
  - Change 3rd Column of Matrix for Side 2 to 3rd Column for Side 1
  - Change 3rd Column of Matrix for Side 3 to 3rd Column for Side 2
  - Change 3th Column of Matrix for Side 4 to 3rd Column for Side 3

When substantially −90 degrees

Multiply Matrix for Side 5 by $2^{nd}$ Matrix

Perform Opposite for sides 1, 2, 3, and 4

In some embodiments, the data registers of the at least one processor 115 can store the matrices for each side. The operations can quickly be performed by using various shift operations.

When the at least one processor 115 received a signal from a particular one of the sensors 45(0) . . . 45(5), including information identifying the detecting sensor, and rotation direction, the at least one processor 115 determines the cubelets 15 that have changed positions, and write the changed position of the cubelets 15 that have changed position. In some embodiments, the at least one processor 115 changes the position of the cubelets 15 directly as in Tables 2 and 3. In some embodiments, the at least one processor 115 changes the position of the cubelets 15 by changing the identifiers of the surfaces of the cubelets on the sides 35 (as shown in the matrices).

Additionally, the at least one processor 115 can determine when the cubelets of the gaming device are in a solved position. For example, the at least one processor 115 can determine that the cubelets 15 of the electronic gaming device 10 are in the solved position when each of the matrices for the sides has the same values, or when a rotation of a side results in the data structure of TABLE 1.

In certain embodiments, the transceiver 125 can be configured to communicate using Bluetooth, ZigBee, WiFi, WiFi P2P, NFC to another electronic device or to an access point to a network. The electronic device, can among other things, provide a graphical user interface for controlling the electronic gaming device 10, and/or act as a gateway to a network, such as the internet as will be described in FIGS. 3-10.

Figure 3A:
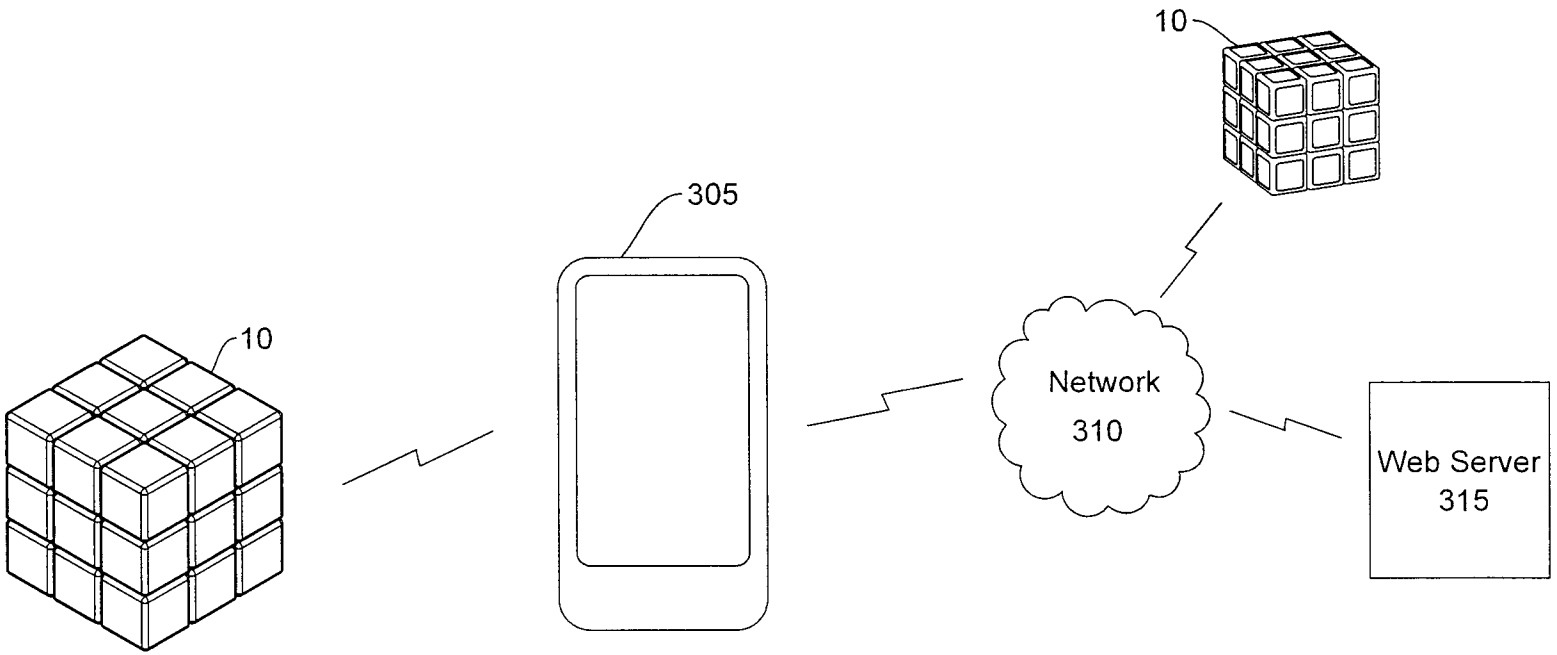
FIG. 3A is a block diagram of a network including an electronic gaming device in accordance with an embodiment of the present disclosure.

Referring now to FIG. 3A, there is illustrated a block diagram of the electronic gaming device 10, an electronic device 305, a network 310, and a web server 315. In certain embodiments, the electronic device 305 can provide a user interface for controlling the electronic gaming device 10, displaying information from the electronic gaming device 10, and provide a gateway to network 310. The network 310 can include, for example, the internet, and include a web server 315. The web server 315 is capable of network communication over the network 310 with other electronic gaming devices 10, and can serve as a platform to facilitate interaction between the electronic gaming devices 10 in the network 310.

The electronic device 305 can comprise, for example, but is not limited to, a smartphone, a tablet, or a personal computer, to name a few. The electronic device 305 and the electronic gaming device 10 can establish a communication connection, which can include, but is not limited to, Bluetooth pairing, WiFi P2P discovery, or NFC. Upon establishment of a communication connection between the electronic gaming device 10 and the electronic device 305, the electronic device 305 can launch an application or program.

Figure 3B:
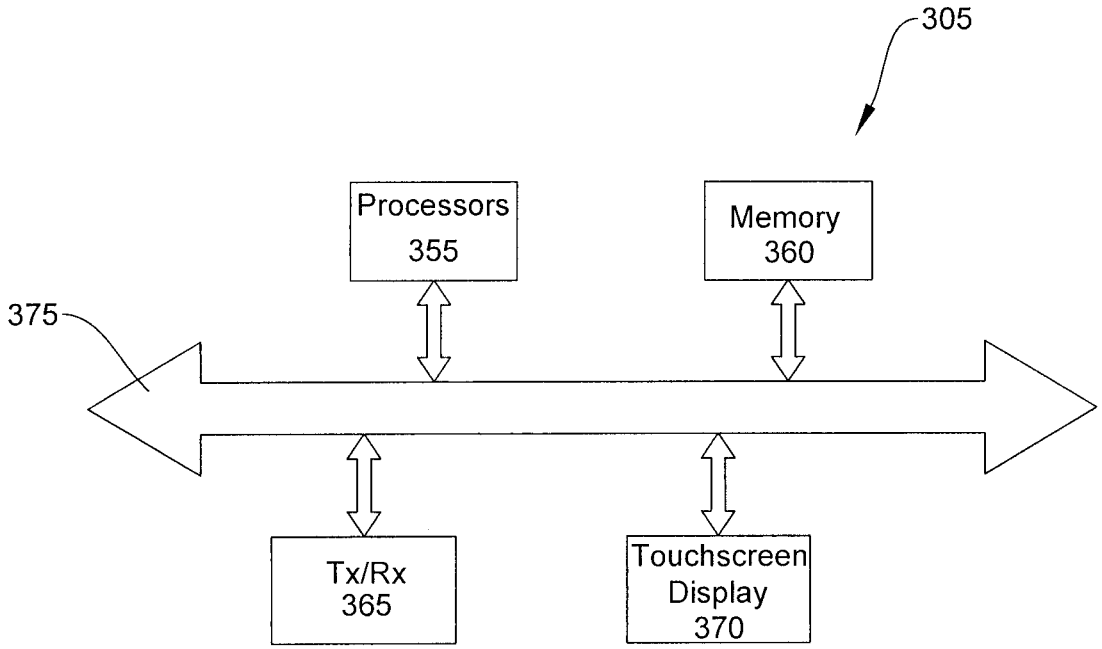
FIG. 3B is a block diagram of an electronic gaming device in accordance with an embodiment of the present disclosure.

Referring now to FIG. 3B, there is illustrated a block diagram of an electronic device 305 according to certain embodiments. The electronic device 305 comprises at least one processor 355, memory 360, transceivers 365, and a touch screen display 370, interconnected by a bus 375. The memory 360 stores data and instructions that are executable by the at least one processor 355. The transceiver 365 can include short-range wireless transceivers, such as Zigbee, Bluetooth, WiFi, and NFC transceivers as well as cellular transceivers. In certain embodiments, one transceiver 365 can establish communication with the electronic gaming device 10, while another transceiver can establish a connection to the network 310. The touch screen display 370 can display graphical user interfaces to facilitate user control of the electronic gaming device 10, for controlling the electronic gaming device 10, as well as displaying various data as will be described below.

Figure 4:
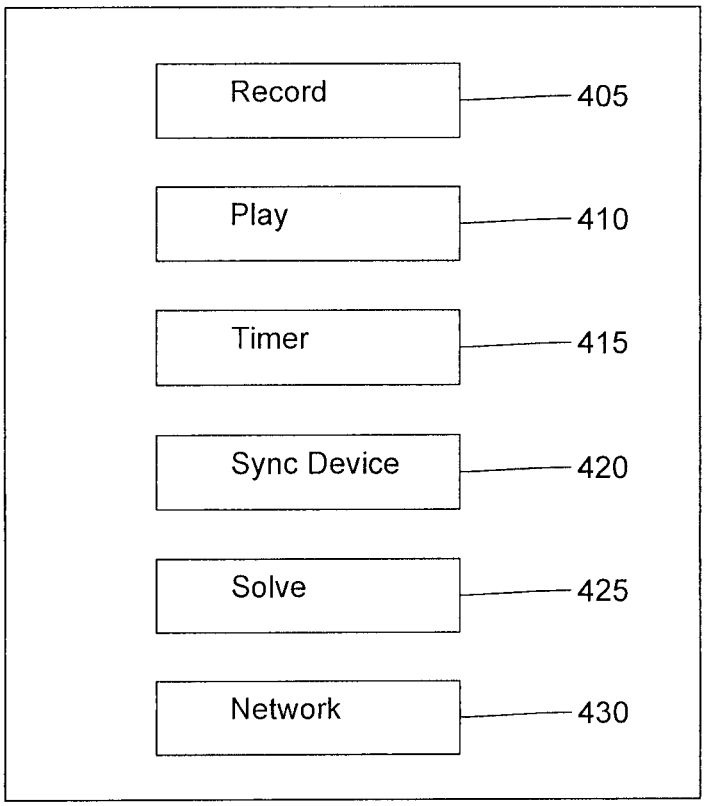
FIG. 4 is an electronic device displaying a graphical user interface in accordance with an embodiment of the present disclosure.

FIG. 4 illustrates a graphical user interface displayable on the electronic device 305 in accordance with one embodiment of the disclosure. When the electronic gaming device 10 and the electronic device 305 have established a communication connection, the electronic device 305 can launch an application or program for controlling the electronic gaming device 10. In certain embodiments, during Bluetooth pairing, or WiFi P2P discovery, electronic gaming device 10 transmits its identification number to the electronic device 305.

In certain embodiments, the electronic device 305 can display a user interface include objects such as buttons for placing the electronic gaming device 10 in a Record Mode, Record Button 405, a Play Mode, Play Button 410, a Timer Mode, Timer Button 415, Synch Mode, Synch Device Button 420, Solve Mode, Solve Button 425, and Networking Mode, Network Button 430. Selection of one of the Record Button 405, Play Button 410, Timer Button 415, Synch Device Button 420, Solve Button 425, and Network Button 430 causes the electronic device 305 to send a signal to the electronic gaming device 10, placing the electronic gaming device 10 in the selected mode. It is noted that selection of a button can include, but is not limited to, pointing and clicking with a mouse, or, where the user interface is displayed on a touchscreen, touching the button.

Figure 5:
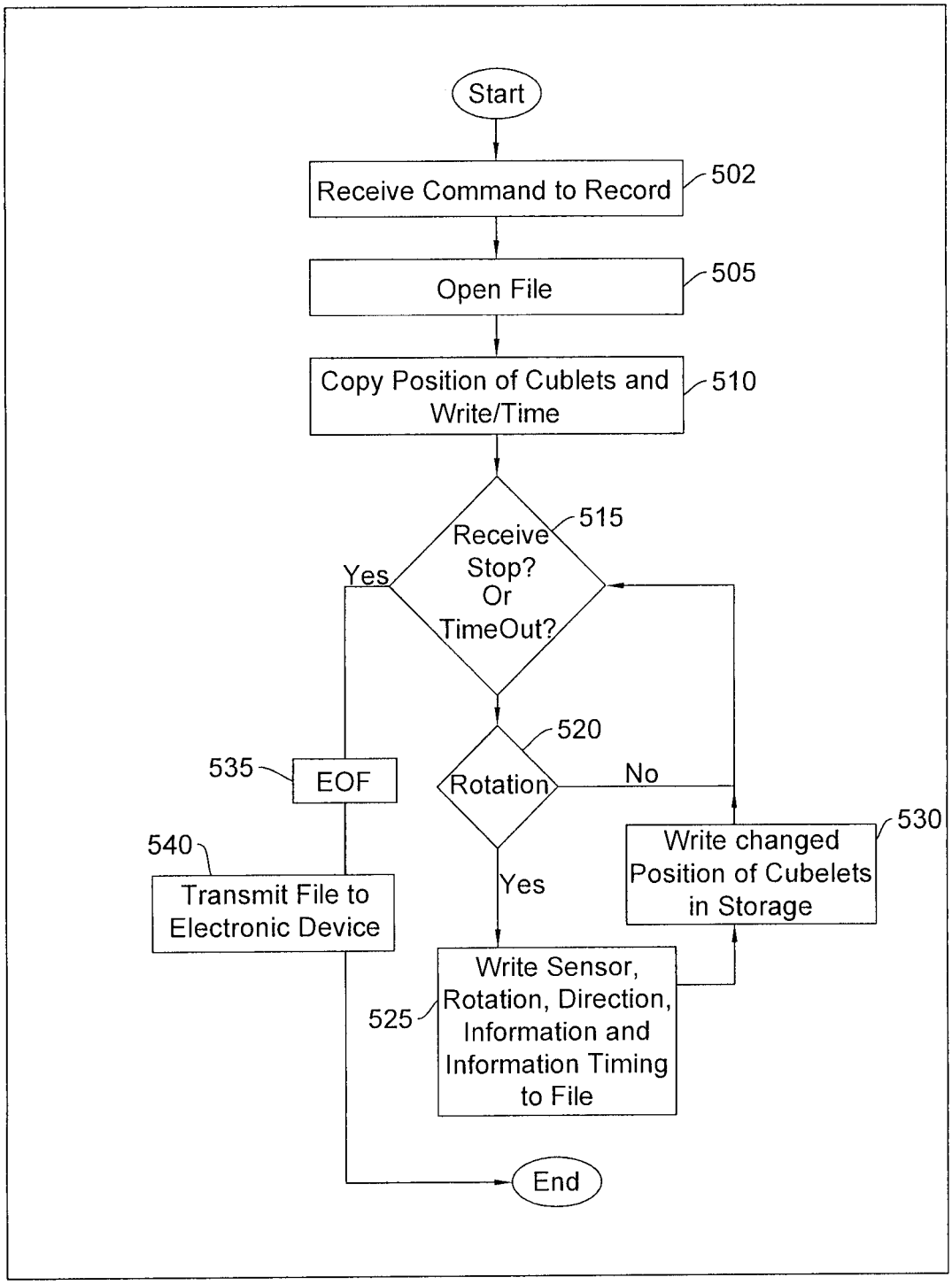
FIG. 5 is a flow diagram describing a Record Mode in accordance with an embodiment of the present disclosure.

Referring now to FIG. 5, there is illustrated a flow diagram describing the Record Mode. Upon selecting the Record Button 405 from FIG. 4, the electronic device 305 transmits a command to the electronic gaming device 10 to enter the Record Mode, and replaces the UI of FIG. 4 with a Stop Button. At 502, the electronic gaming device 10 receives the command to enter the Record Mode via the transceiver 125. Responsive thereto, the at least one processor 115 opens a new file in the memory 120 at 505. At 510, the at least one processor 115 writes the time and position of each of the plurality of interchangeable cubelets (e.g., Tables 1-3, or the matrices for each side) to the file in the memory 120 from storage. At 515 and 520, electronic gaming device 10 waits for either a Stop Command or a sensor 45(0) . . . 45(5) to detect rotation of a center cubelet 15'(0) . . . 15'(5).

When one of the sensors 45(0) . . . 45(5) detects rotation of one of the center cubelets 15'(0) . . . 15'(5) by substantially +/−90 degrees, the at least one processor 115 writes the identity of the detecting sensor 45(0) . . . 45(5), the rotation direction information, and timing information into the file at 525. The sensor/rotation direction information can be written as one of 0 . . . 5 followed by a "+" for approximately 90 degrees, a "−" for approximately 90 degrees. The timing information can include the times that the rotation sensor 45(0) . . . 45(5) detected the start of the rotation and the time that the rotation stopped. Alternatively, in some embodiments, rotations can be detected in finer increments (+/−1, 15, 30, 45 degrees) and the times that each increment of the rotation occurred can be written. In some embodiments, the electronic gaming device 10 can stream the detecting sensor 45(0) . . . 45(5), rotation direction information, and timing information to the electronic device 305. In some embodiments, information from the gyroscope 150 can also be written. At 530, the at least one processor 115 determines the cubelets 15 that have changed positions based on the detecting sensor, and writes the changed positions for the cubelets that have change position in the storage, based on the detecting sensor, and rotation direction information. Steps 515-530 are repeated until the user selects the Stop Button. When the user selects the Stop Button, the electronic device 305 transmits a Stop Command to the electronic gaming device 10 that is detected during 515.

When the Stop Command is detected during 515, the at least one processor 115 completes the file, by, for example, writing an End of File "EOF" to the file at 535. At 540, the transceiver 125 can optionally transmit the file to the electronic device 305. It is noted that by while the initial position of the cubelets 15 are copied from the storage to the file during 510, when the changed positions of the cubelets that have changed position are written to storage during 530, the positions of the cubelets, may, but are not necessarily, copied to the file. Selection of the Stop Button causes the electronic device to revert to the interface of FIG. 4.

Figure 6:
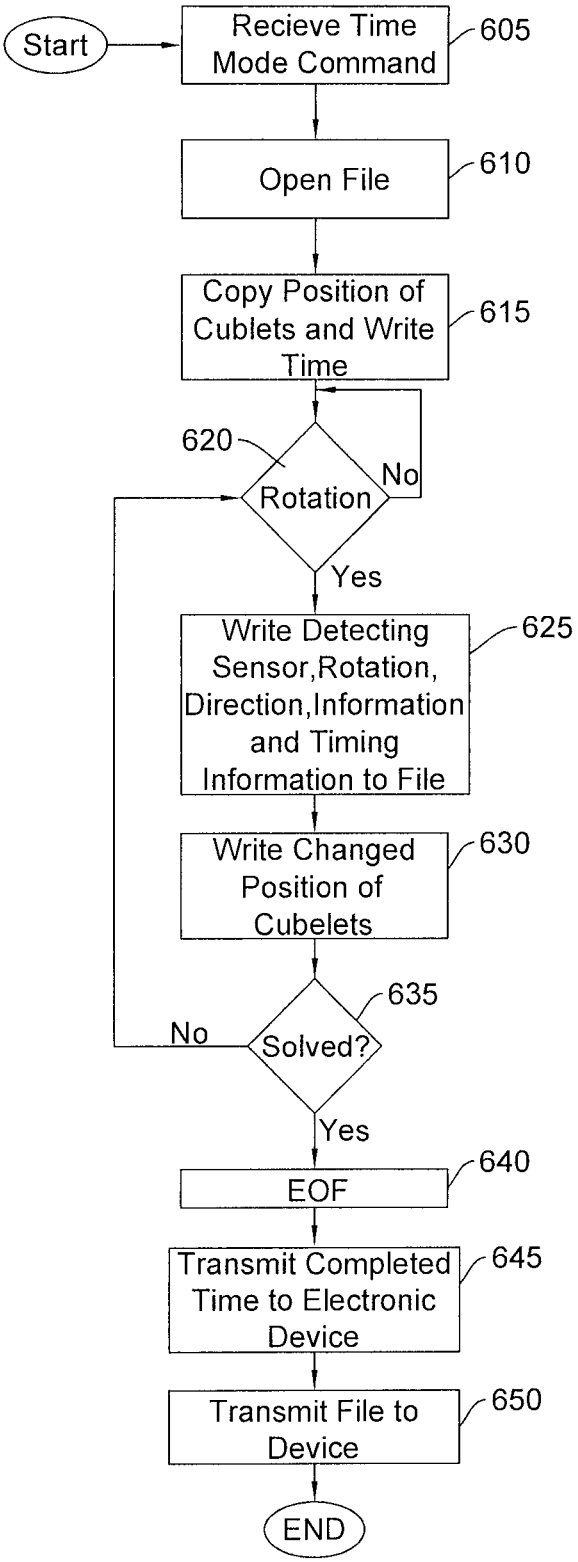
FIG. 6 is a flow diagram describing a Timer Mode in accordance with an embodiment of the present disclosure.

Referring now to FIG. 6, there is illustrated flow diagram describing the timer mode. When the Timer Button 410 is selected, the electronic device 305 transmits a Timer Mode Command to the electronic gaming device 10. At 605, the electronic gaming device 10 receives the Timer Mode Command via transceiver 125. At 610, the at least one processor 115 opens a file in the memory 120. At 615, the at least one processor 115 copies the positions of the cubelets 15 from the storage to the file. At 620, the electronic gaming device 10 waits for a sensor 45(0) . . . 45(5) to detect rotation of a center cubelet 15' by substantially +/−90 degrees. Upon receipt of a signal from a sensor 45(0) . . . 45(5), the at least one processor 115 writes the identity of the detecting sensor 45 to the file with the rotation direction information, and timing information at 625. In some embodiments, the electronic gaming device 10 can stream the detecting sensor, rotation direction information, and timing information to the electronic device 305. At 630, the at least one processor 115 writes the changed position of the cubelets changing positions to the storage. At 635, a determination is made whether the electronic gaming device 10 is solved. If the electronic gaming device 10 is not solved at 635, 620-630 are repeated until the electronic gaming device 10 is solved.

When the electronic gaming device 10 is solved at 635, the file is closed, e.g., by writing end of file, "EOF", to the file at 640. At 645, the time to completion is transmitted to the electronic device 305 for display. The time of completion can be determined by taking the time elapsed from the time that the first sensor detected a movement to the ending time of detection of the last sensor. At 650, the file can be transmitted from the electronic gaming device 10 to the electronic device 20 via transceiver 125. In certain embodiments, the time of start can be the time the electronic gaming device 10 receives the Timer Mode Command at 605. Alternatively, the time of start can be the time that the first sensor detected a movement, provided that it is no later than a predetermined time, e.g., such as 2 seconds, after the electronic gaming device 10 received the Timer Mode Command at 605 to prevent the user from excessively strategizing prior to timing. If the time that the first sensor detected a movement is later than the predetermined time after the electronic gaming device 10 received the Timer Mode Command at 605, then the time the electronic gaming device 10 received the Timer Mode Command is used as the start time.

Referring now to FIG. 7, there is illustrated a block diagram of the Play Mode of operation. During the Play Mode, the user can select a file to graphically view the cube being manipulated on the electronic device 305. FIG. 7A is a block diagram of an electronic device 305 displaying a plurality of file identifiers 705(1) . . . **705(*n*). The file identifiers 705(1) . . . 705(*n*) identify files that can be stored in the electronic device 305, files that are stored in the memory 120 of the electronic gaming device 10, and even files that are stored in cloud systems. The files can be stored in the electronic device 305, such as during 540 in the Record Mode, or during 650 during the Timer Mode. In some embodiments, the electronic device 305 generates the files with the streamed information during steps 525 and 625. In certain embodiments, when the electronic gaming device 10 and the electronic device 305 establish a communication link, the memory 120 of the electronic gaming device 10 is accessible by the electronic device 305**. The files can be copied and transferred in a variety of manners well known in the art.

Upon selection of a file identifier 705, e.g., file identifier **705(*k*), the electronic device 305 renders a graphic 710(0) of the electronic gaming device 10 with the initial positions of the cubelets that is written to the file. It is noted that while surfaces of cubelets 15, and sides 35 of the gaming device may be recorded as numbers, electronic device 305 can determine the corresponding colors and render the colors. In some embodiments, the electronic device 305** can assign an arbitrary pattern of colors.

A sequence of detected sensor/direction pairs 715(0 . . . *n*) are displayed at the top.

A timer bar 720 is displayed at the bottom with a start time 720(0) and a stop time 720(1). The start time 720(0) can be the time recorded at 510 or 615, and the stop time 720(1) can be the end time recorded when the last sensor 45 finished detecting rotation, such as the last iteration of 525 or 625. The times can also be relative, such that the start time 720(0) is 0 and the stop time 720(1) is the elapsed time.

For each of the detecting sensor/direction pairs 715, the electronic device 305 animates the rotation and direction of the indicated side on the graphic 710 of the cube, determines the changed position of the cubelets 15, and renders a graphic 710 of the electronic game cube with the cubelets 15 in the changed position.

Figure 7A:
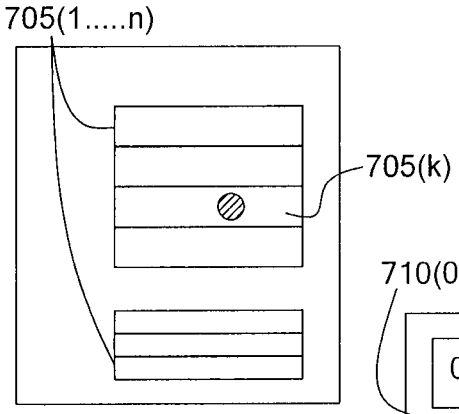
FIGS. 7A-7E are block diagrams describing a Replay Mode in accordance with an embodiment of the present disclosure.
Figure 7B:
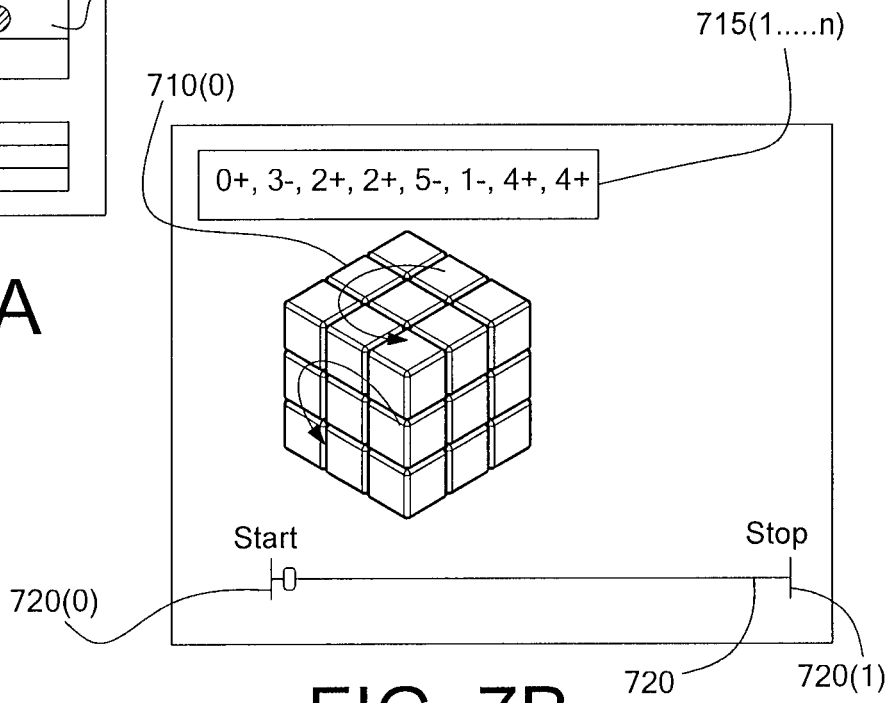
Figure 7C:
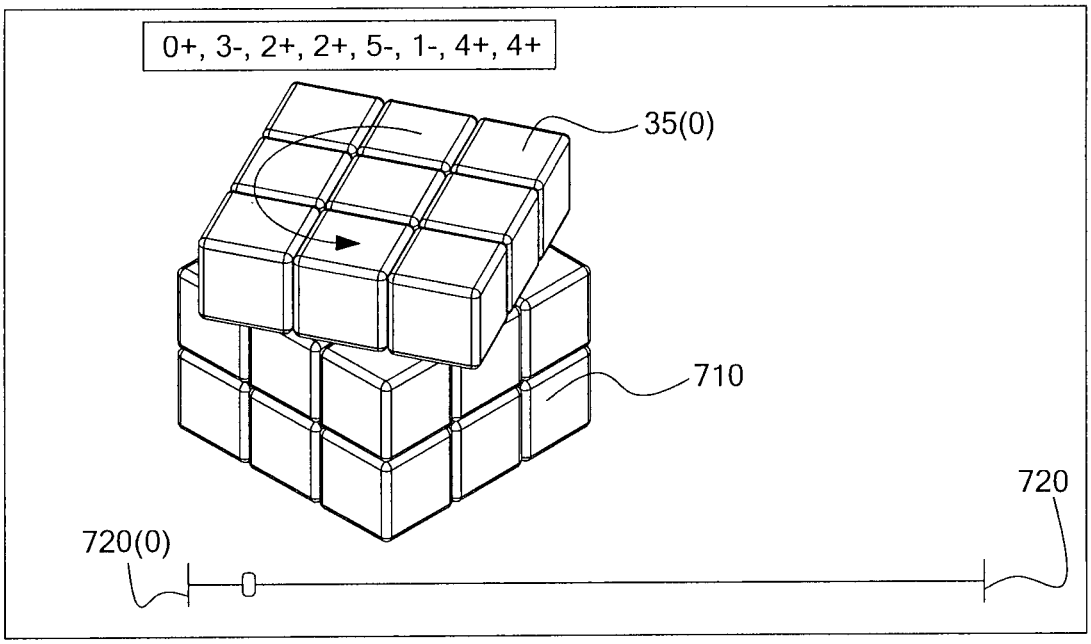
Figure 7D:
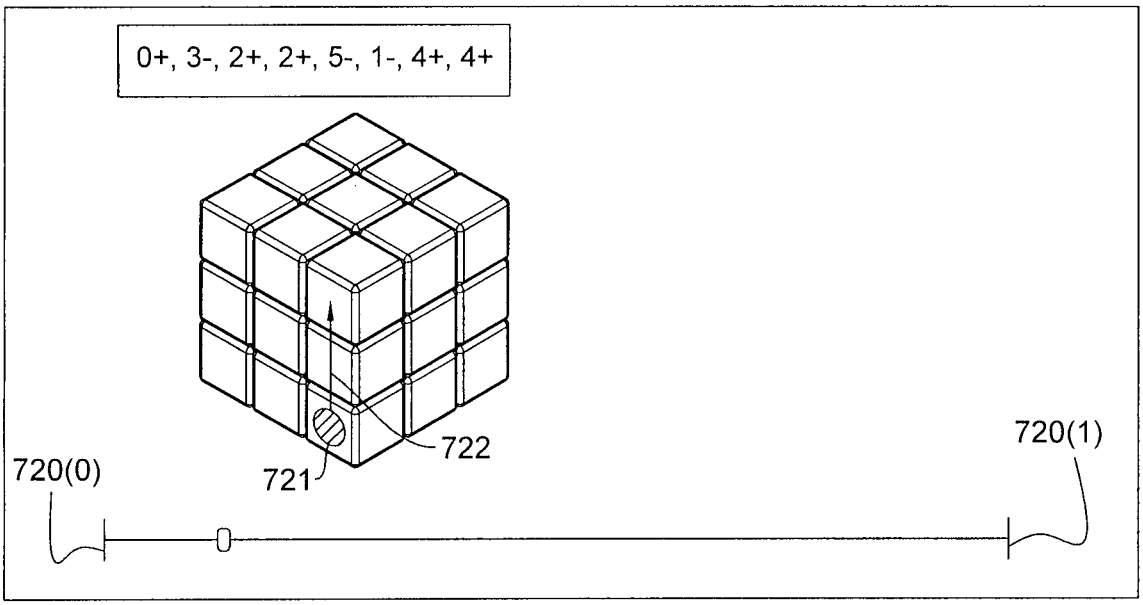

For example, FIG. 7B starts with detecting sensor/direction pair "0+" 715(1). The electronic device 305 can determine the changed position of the cubelets, by executing a program, such as the programs for updating the position of the cubelet described above. FIG. 7C shows an animation of the face of the electronic gaming device 10 with side 35(0) rotating +90 degrees. Since the file has the times that sensor 35(0) detected the rotation, the animation can occur according to the foregoing times. In some embodiments, "0+" can be highlighted. At the completion of the animation for "0+" 715(1), the electronic device 305 renders a graphic of the electronic gaming device 10 with the resulting position of the cubelets in FIG. 7D.

Figure 7E:
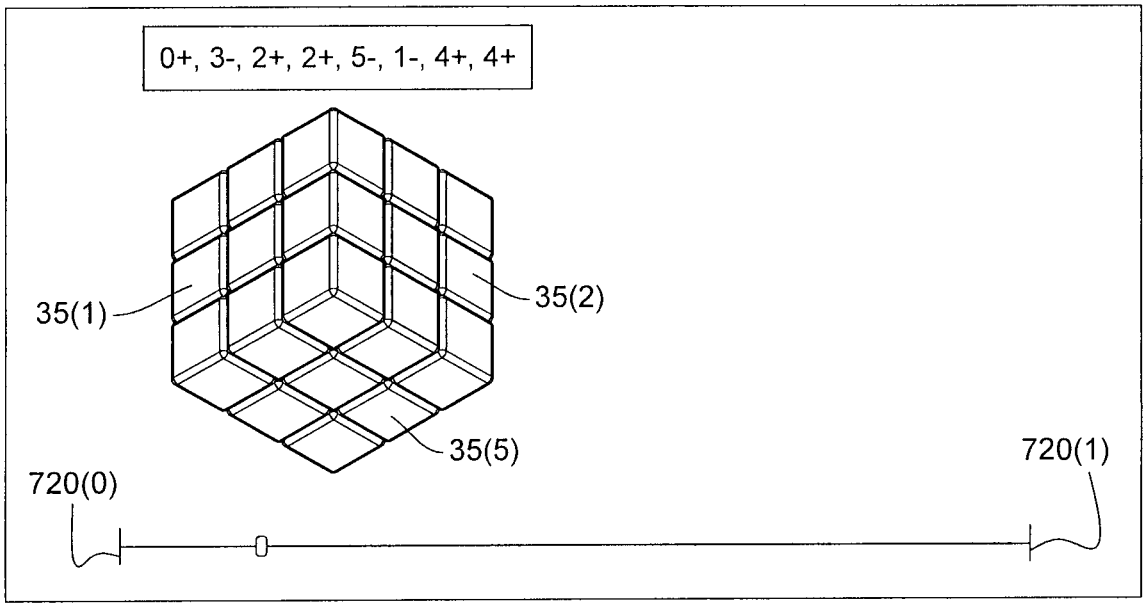

The electronic device 305 animates each of the detecting sensor/direction pairs 715(1) . . . **715(*n*) according to the times associated with each sensor/direction pair. It is noted that the electronic device 305 can only display the graphic 710 of some sides of the electronic gaming device. For example, the graphic 710 may only show the sides 35(0), 35(1) 35(2). The user can make a touch 721 and drag 722 gesture on the graphic 710 of the electronic gaming device on the display and drag upwards, thereby revealing the side 35(5) as shown in FIG. 7E. The user can push upwards either a limited amount, such as only revealing the side 35(5) or enough to flip the side 35(5) to the top (thereby revealing the sides 35(3), 35(4)**). Similarly, the user can gesture right and left.

In some embodiments, by default, the animation will occur according to the actual times stored in the files. In other embodiments, the user can slow down the speed by various inputs. In some embodiments, the electronic gaming device 10 can include gyroscopic movements indicating which side of the electronic gaming device 10 was upwards when the user was making the rotations. For example, it is common that the side of the electronic gaming device 10 that is of interest to the user will be either the top or the front facing the user. The electronic device 305 can turn the cube according to the gyroscopic movements to reveal the side of the electronic gaming device 10 that is of interest to the user.

Additionally, in some embodiments, the electronic device 305 can automatically orient the graphic 710 of the electronic gaming device 10 to emphasize the side that is of interest. A common solution of the electronic gaming device 10 is to solve the electronic gaming device in layers. For example, a user may start with aligning the cubelets of the side with the side 35(0) and finish by aligning the cubelets of the side 35(5). As the user works from the side 35(0) towards the side 35(5), the electronic device 305 can automatically adjust the orientation of the graphic 710 of the electronic gaming device 10.

The Synch Device Button 425 determines the position of each cubelet 15 and writes the position of each cubelet 15 to the storage. It is possible that the storage does not store the accurate positions of the cubelets 15. This can happen when the user removes and replaces the cubelets 15. Alternatively, the user may manipulate the electronic gaming device 10 when the electronic gaming device 10 has no power. Accordingly, selection of the Synch Device Button 425 causes the electronic device 305 to write the position of each cubelet 15 to the storage.

Figure 8:
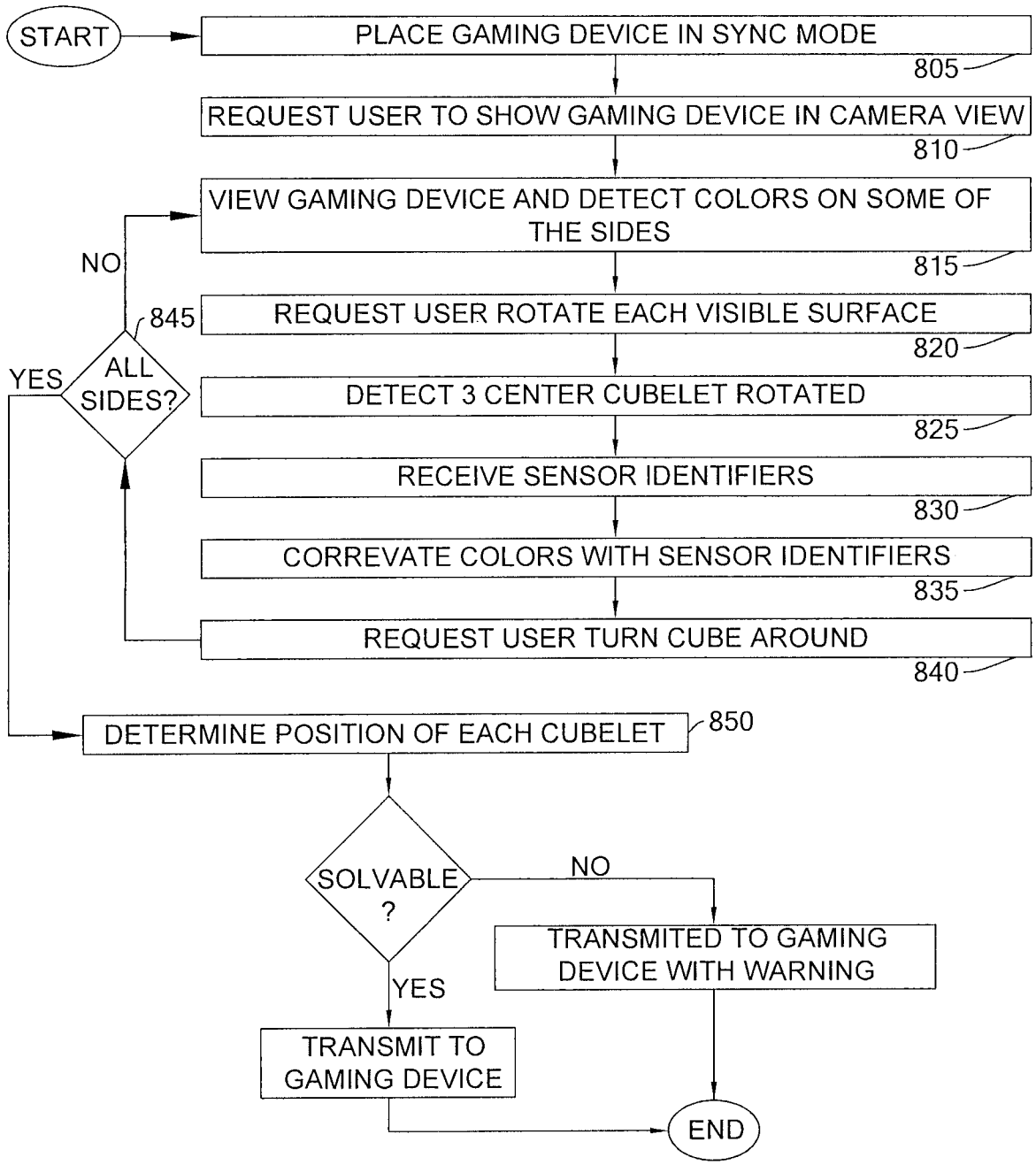
FIG. 8 is a flow diagram describing a Synchronization Mode in accordance with an embodiment of the present disclosure.

FIG. 8 is a flow diagram describing how the electronic device 305 writes the position of the cubelets 15 to the storage of the electronic gaming device 10. At 805, the electronic device 305 places the electronic gaming device 10 into a synch mode. At 810, the electronic device 305 prompts the user to move the electronic gaming device 10 into the view of the camera. At 815, from the camera view, the electronic device 305 detects the colors on some of the sides 35 (e.g., sides 35(0), 35(1), 35(2)) and detects the colors of the center cubelets 15'. The electronic device 820 then prompts the user to rotate each surface 35 that is visible in the camera view, detects the color of the center cubelet 15' of each rotated surface (825), and receives signals from the electronic gaming device 10, identifying the detecting sensor (830). At 835, the electronic device 305 correlates the color of the center cubelets 15' with the identity of the sensors 45 attached thereto. At 840, the electronic device 305 prompts the user to turn the gaming device to reveal the opposite side, and repeats steps 815-840. When all sides of the cube have been viewed by the electronic device 305, the electronic device 305 determines the position of each cubelet 15.

From viewing all sides 35 of the electronic gaming device 10, and correlating the colors with the identified sensors, the electronic device 305 generates a data structure describing the position of the cubelets, such as Table 1, or six matrices at 850. It is noted that the cubelets 15 can be physically placed in positions that cannot be attained by manipulation, and are therefore, unsolvable. At 855, the electronic device 305 determines whether the position of the cubelets place the gaming device in a solvable state. In certain embodiments, the electronic device 305 can use, for example, the Fridrich Method. The electronic device 305 transmits that position of the cubelets 15 to the electronic gaming device 10. If the position of the cubelets is not in a solvable state, the electronic device 305 also displays a warning. After transmitting the position of the cubelets 15, the electronic device 305 reverts to the menu of FIG. 4.

When the user presses the Solve Button 425, the electronic device 305 provides a sequence of side/rotation pairs that result in placing the cubelets in a solved position.

Figure 9:
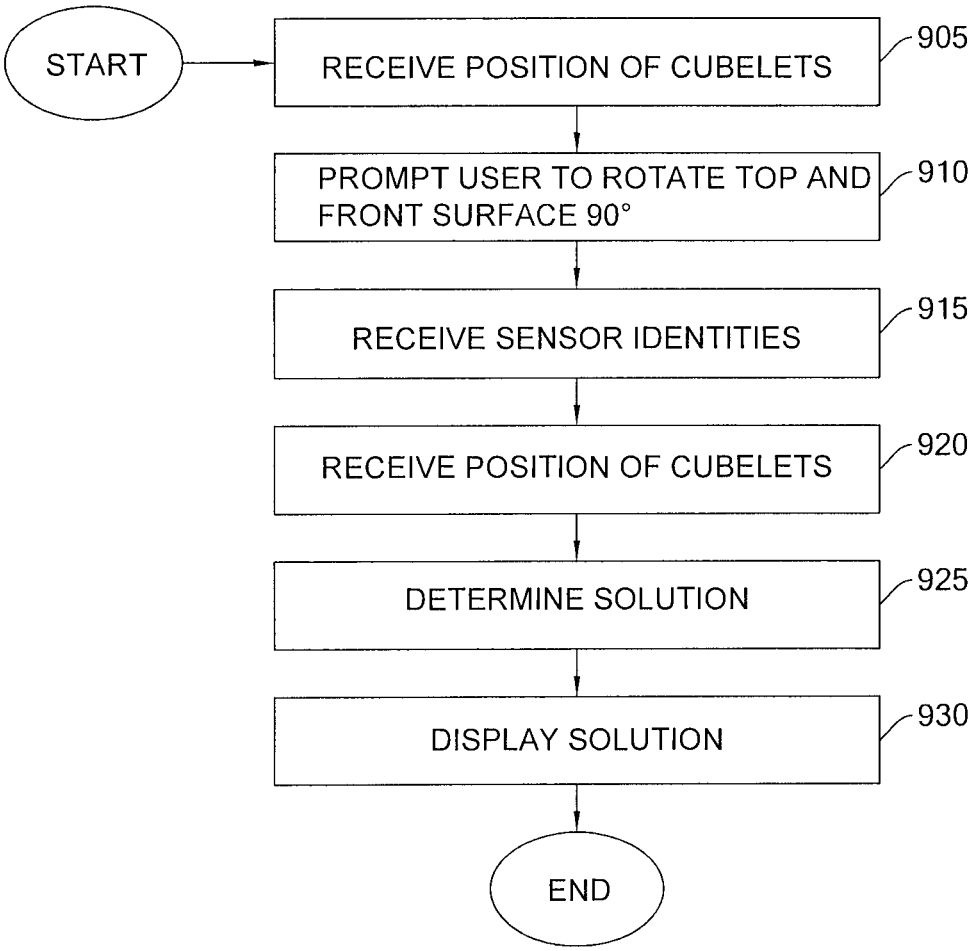
FIG. 9 is a flow diagram describing a Solve Mode in accordance with an embodiment of the present disclosure.

Referring to FIG. 9, at 905, the electronic device 305 receives the position of the cubelets 15 from storage. In certain embodiments, receiving the position of the cubelets 15 can be obtained by the requesting electronic device 305, and the electronic gaming device 10 transmitting the position of the cubelets 15 from the storage. In certain embodiments, the electronic device 305 can read the storage of the electronic gaming device 10.

It is noted that with the position of the cubelets 15, the electronic device 305 can generate a virtual electronic gaming device 10 and determine a set of side/rotation directions that would place the cubelets 15 in a solve position, in terms of the sensor numbers. However, for convenience to the user, the electronic device 305 provides the side/rotation direction in terms of Top/Bottom/Left/Right, Front, and Back.

Therefore, at 910, the electronic device 305 prompts the user to rotate the top surface (surface 35(0) of FIG. 1) and the front surface (surface 35(1) of FIG. 1) and determines the sensors 45 that are at the top and front. In some embodiments, the electronic device 305 can determine the top and front sensor by reading the gyroscope 150. With this information, the electronic device 305 can correlate the sensors with Top/Bottom/Front/Back/Left/ and Right. At 920, the electronic device 305 receives the position of the cubelets after the rotations during 915. At 925, the electronic device 305 determines a solution sequence for placing the cubelets in a solved position.

It is noted that there are numerous of algorithms well known in the art for placing the cubelets in a solved position. In certain embodiments, the electronic device 305 can provide the six matrices to www.rubikscubesolver.com.

At 930, the electronic device 305 can provide the solution to the user. The solution can be provided in a number of different ways. In one embodiment, the electronic device 305 can simply display the sequence of moves. In another embodiment, the electronic gaming device 10 can use the speaker for telling the user which surfaces to turn. In another embodiment, the electronic device 305 can animate a surface and rotation direction on the device, wait for the electronic gaming device 10 to stream the appropriate sensor information and rotation direction information, and animate the next surface and rotation repetitiously until the electronic gaming device 10 is solved.

After operation 930, the electronic device reverts to the user interface of FIG. 4. When the user selects the Network Button 430, the electronic device 305 accesses the server 315 over the network. When the electronic device 305 is paired with the electronic gaming device 10, the electronic device 305 can communicate the MAC number to the web server 315.

Figure 10:
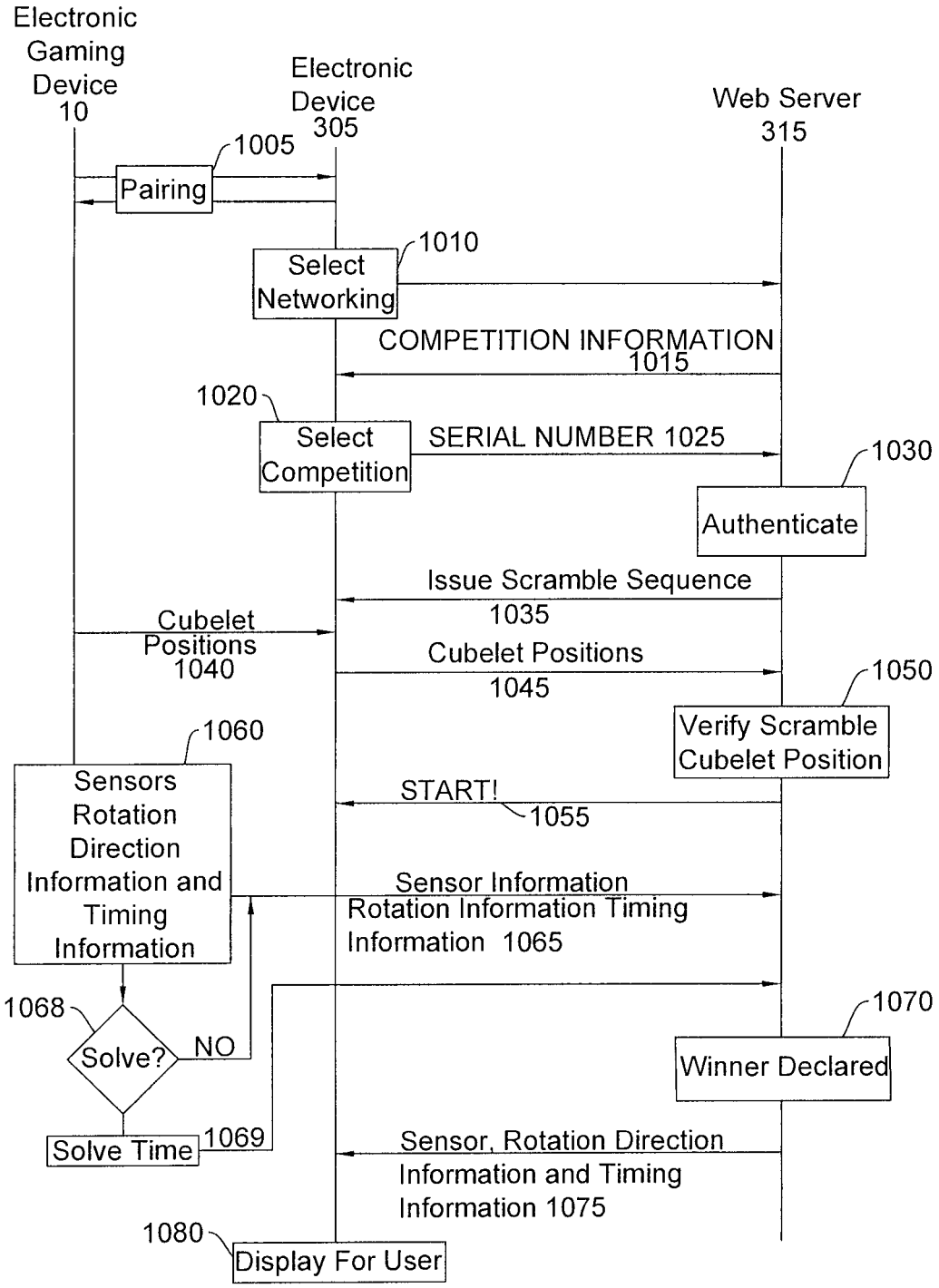
FIG. 10 is a signal flow diagram illustrating usage of the electronic gaming device over a network in accordance with an embodiment of the present disclosure.

When electronic device 305 accesses the web server 315, the user can enter a competition. Referring now to FIG. 10, there is illustrated a signal flow diagram describing a competition mode. At 1005, the electronic gaming device 10 and the electronic device 305 establish a communication connection, including but not limited to pairing. At 1010, the electronic device 305 displays and the user selects the Networking Button 430. Responsive to selection of the Networking Button 430, the electronic device 305 accesses a predetermined web server 315. The web server 315 provides information on different competitions at 1015 which are displayed on the electronic device 305. The user selects a competition at 1020 by entering an input on the electronic device 305. In response to the user selecting a competition at 1020, the electronic device 305 transmits the serial number of the electronic gaming device 10 to the web server 315 at 1025. At 1030, the web server 315 authenticates the electronic gaming device 10 as within the specification and rules of the competition. At 1035, the web server 315 provides a scramble sequence. In certain embodiments, the web server 315 can instruct the user to start with an electronic gaming device 10 with cubelets 15 in a solved position, and turn a particular color upwards, with another particular color at the front. The user rotates the indicated sides 35 in the provided rotation directions. When the user follows the scramble sequence, the position of the cubelets 15 is streamed at regular intervals to the web server 315 to verify that the cubelets are in the scrambled position at 1050.

After verification, the web server 315 issues a command to start solving the gaming device at 1055. At 1060, the sensors 45 provide rotation direction information, and timing information that are streamed at 1065 to the web server 315 via the electronic device 305 until the user solves the electronic gaming device 10 at 1068. When the electronic gaming device 10 determines that cubelets are in a solved position at 1068, the solution time is transmitted to the web server 315 at 1069. At 1070, the web server 315 determines the fastest solution time and declares a winner. At 1075, the sensor, rotation direction, and timing information for the fastest solution time are transmitted and displayed on the electronic device at 1080.

While the disclosure has been shown and described with reference to certain exemplary embodiments thereof, it will be understood by those skilled in the art that various changes in form and details may be made therein without departing from the spirit and scope of the disclosure as defined by the appended claims and their equivalents.

What is claimed is:

1. An electronic gaming device comprising:

a plurality of axles, wherein each of the plurality of axles is rotatably connected to center cubelets;

a plurality of sensors corresponding the plurality of axles, where each of the plurality of sensors is operatively coupled to a corresponding one of the plurality of axles, and responsive to detecting rotation of a center cubelet rotatably connected to the corresponding one of the plurality of axles in a direction, transmitting a signal identifying a sensor of the plurality of sensors and the direction;

a plurality of interchangeable cubelets positioned about the plurality of axles such that mechanical rotation of a set of the plurality of interchangeable cubelets having a common plane causes rotation of one center cubelets;

storage for storing a position of each of the plurality of interchangeable cubelets; and at least one processor configured to receive signals from the plurality of sensors, and responsive to receiving a signal identifying a particular one of the plurality of sensors and direction, determine changes in position of some of the plurality of interchangeable cubelets, and write the changed positions for the some of the plurality of interchangeable cubelets to the storage, wherein the at least one processor is configured to write an identification of the particular one of the plurality of sensors and the direction and a time in a file in the storage.

2. An electronic gaming device comprising:

a plurality of axles, wherein each of the plurality of axles is rotatably connected to center cubelets;

a plurality of sensors corresponding the plurality of axles, where each of the plurality of sensors is operatively coupled to a corresponding one of the plurality of axles, and responsive to detecting rotation of a center cubelet rotatably connected to the corresponding one of the plurality of axles in a direction, transmitting a signal identifying a sensor of the plurality of sensors and the direction;

a plurality of interchangeable cubelets positioned about the plurality of axles such that mechanical rotation of a set of the plurality of interchangeable cubelets having a common plane causes rotation of one center cubelets;

storage for storing a position of each of the plurality of interchangeable cubelets; and at least one processor configured to receive signals from the plurality of sensors, and responsive to receiving a signal identifying a particular one of the plurality of sensors and direction, determine changes in position of some of the plurality of interchangeable cubelets, and write the changed positions for the some of the plurality of interchangeable cubelets to the storage, wherein the electronic gaming device further comprises a transceiver, and wherein responsive to receiving the signal identifying the particular one of the plurality of sensors and the direction, the transceiver transmits an identification of the particular one of the plurality of sensors, the direction and a time to an external electronic device.

3. An electronic device comprising:

a display;

at least one processor connected to the display;

a memory storing a plurality of executable instructions, wherein execution of the plurality of executable instructions cause the at least one processor to:

receive an initial position of a plurality of interchangeable cubelets about a plurality of axles;

render the initial position of the plurality of interchangeable cubelets;

receiving an identification of one of a plurality of sensors, and a direction of rotation;

determine a set of interchangeable cubelets from the initial position that caused the one of the plurality of sensors to detect rotation;

determine a new position of the set of interchangeable cubelets based on the identification of one of the plurality of sensors and the direction of rotation, thereby resulting in a new position of the plurality of interchangeable cubelets; and render the new position of the plurality of interchangeable cubelets based on the new position of the set of interchangeable cubelets, wherein rendering the new position comprises animating rotation of the set of interchangeable cubelets in the direction, and wherein receiving the identification comprises receiving timing information associated with the identification of the one of the plurality of sensors and the direction and wherein animating the rotation comprises animating the rotation according to the timing information.

4. The electronic device of claim 3, wherein receiving the identification of the one of the plurality of sensors and the direction comprise receiving the identification of one of the plurality of axles and the direction from a file stored in the electronic device.

5. The electronic device of claim 3, wherein rendering the new position of the plurality of interchangeable cubelets comprises rendering the new position of the plurality of interchangeable cubelets from a particular vantage point, and wherein execution of the plurality of executable instructions cause the at least one processor to:

receive an input; and change the particular vantage point to another vantage point, based on the input.

6. The electronic device of claim 5, wherein change the particular vantage point to the another vantage point further comprises displaying at least one of the plurality of interchangeable cubelets that are not displayed at the particular vantage point.

7. The electronic device of claim 3, wherein receive the initial position of the plurality of interchangeable cubelets about the plurality of axles comprises receiving at least two images of an electronic gaming device.

* * * * *